US006988961B2

(12) United States Patent
Nesbitt

(10) Patent No.: US 6,988,961 B2
(45) Date of Patent: Jan. 24, 2006

(54) GOLF BALL HAVING A CONTROLLED WEIGHT DISTRIBUTION ABOUT A DESIGNATED SPIN AXIS AND A METHOD OF MAKING SAME

(75) Inventor: R. Dennis Nesbitt, Hernando, FL (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/925,493

(22) Filed: Aug. 25, 2004

(65) Prior Publication Data

US 2005/0026725 A1 Feb. 3, 2005

Related U.S. Application Data

(62) Division of application No. 10/015,526, filed on Dec. 13, 2001, now Pat. No. 6,846,248.

(51) Int. Cl.
*A63B 37/06* (2006.01)

(52) U.S. Cl. ..... 473/373

(58) Field of Classification Search ..... 473/373, 473/374, 372, 376, 378
See application file for complete search history.

(56) References Cited

U.S. PATENT DOCUMENTS

| | | | |
|---|---|---|---|
| 728,311 | A | 5/1903 | Singer |
| 737,031 | A | 8/1903 | Short |
| 1,120,757 | A | 12/1914 | Steinberger |
| 2,859,968 | A | 11/1958 | Modica, Jr. |
| 3,313,545 | A | 4/1967 | Bartsch |
| 3,373,123 | A | 3/1968 | Brice |
| 3,384,612 | A | 5/1968 | Brandl et al. |
| 3,819,190 | A | 6/1974 | Nepela et al. |
| 3,874,663 | A | 4/1975 | Kahle |
| 4,058,310 | A | 11/1977 | Miettinen |
| 4,194,737 | A | 3/1980 | Farmer |
| 4,274,637 | A | 6/1981 | Molitor |
| 4,332,102 | A | 6/1982 | Caffrey |
| 4,609,196 | A | 9/1986 | Bozinovic |
| 4,664,387 | A | 5/1987 | Tardiff |
| 4,679,795 | A | 7/1987 | Melvin et al. |
| 4,863,167 | A | 9/1989 | Matsuki et al. |
| 4,974,511 | A | 12/1990 | Hsi-Chou |
| 5,026,067 | A | 6/1991 | Gentiluomo |
| 5,104,126 | A | 4/1992 | Gentiluomo |
| 5,306,760 | A | 4/1994 | Sullivan |
| 5,312,857 | A | 5/1994 | Sullivan |
| 5,358,448 | A | 10/1994 | Stephens |
| 5,688,869 | A | 11/1997 | Sullivan |
| 5,779,562 | A | 7/1998 | Melvin et al. |
| 5,779,563 | A | 7/1998 | Yamagishi et al. |
| 5,779,564 | A | 7/1998 | Nakamura et al. |
| 5,807,192 | A | 9/1998 | Yamagishi et al. |
| 5,846,141 | A | 12/1998 | Morgan et al. |
| 5,876,294 | A | 3/1999 | Yamagishi et al. |
| 5,899,822 | A | 5/1999 | Yamagishi et al. |

(Continued)

*Primary Examiner*—Raeann Gorden
(74) *Attorney, Agent, or Firm*—Michael A. Catania; Elaine H. Lo

(57) ABSTRACT

A golf ball is provided having a controlled weight distribution about a designated spin axis. The golf ball includes a core defining one or more high density regions interiorly disposed along a common plane and centered about the horizontal spin axis of the ball. As a result of the controlled weight distribution, the resulting ball significantly reduces hooks and slices. A method of manufacturing and/or utilizing the present golf ball is also provided.

1 Claim, 13 Drawing Sheets

U.S. PATENT DOCUMENTS 5,984,806 A * 11/1999 Sullivan et al. ..... 473/373
6,004,225 A 12/1999 Owens et al.
6,010,412 A 1/2000 Moriyama
6,045,460 A 4/2000 Hayashi et al.
6,048,279 A 4/2000 Masutani
6,117,025 A 9/2000 Sullivan
6,120,393 A 9/2000 Sullivan et al.
6,142,887 A 11/2000 Sullivan et al.
6,174,247 B1 1/2001 Higuchi et al.
6,180,722 B1 1/2001 Dalton et al.
6,193,618 B1 2/2001 Sullivan et al.
6,196,937 B1 3/2001 Kuttappa
6,244,977 B1 6/2001 Sullivan et al.
6,261,193 B1 * 7/2001 Sullivan et al. ..... 473/377
6,277,034 B1 8/2001 Nesbitt et al.
6,299,550 B1 10/2001 Molitor et al.
6,309,312 B1 10/2001 Sullivan et al.
6,315,681 B1 11/2001 Sullivan
6,846,248 B2 * 1/2005 Nesbitt ..... 473/373

* cited by examiner

GOLF BALL HAVING A CONTROLLED WEIGHT DISTRIBUTION ABOUT A DESIGNATED SPIN AXIS AND A METHOD OF MAKING SAME

CROSS REFERENCE TO RELATED APPLICATIONS

This application is a divisional of U.S. application Ser. No. 10/015,526, filed Dec. 13, 2001 now U.S. Pat. No. 6,846,248.

FIELD OF THE INVENTION

The present invention relates to golf balls and, more particularly, to an improved golf ball construction having a controlled weight distribution about a designated spin axis. The weight distribution imparts stable spin characteristics to the golf ball and corrects side spin caused when the ball is not squarely hit. In addition, the golf ball of the subject invention exhibits an increased coefficient of restitution (C.O.R.) and enhanced travel distance. The present invention is also directed to a method for producing a golf ball having a controlled weight distribution about a designated spin axis.

BACKGROUND OF THE INVENTION

Generally, there are at least three different types of golf balls that are currently commercially available. These are one-piece balls, multi-piece solid balls having two or more solid pieces or components, and wound balls.

The one-piece ball typically is formed from a solid mass of moldable material which has been cured to develop the necessary degree of hardness. The one-piece ball possesses no significant difference in composition between the interior and exterior of the ball. These balls do not have an enclosing cover. They are utilized frequently as range balls or practice balls. One piece balls are described, for example, in U.S. Pat. No. 3,313,545; U.S. Pat. No. 3,373,123; and U.S. Pat. No. 3,384,612.

Conventional multi-piece solid golf balls, on the other hand, include a solid resilient center or core comprising a single or multiple layer of similar or different types of materials. The core is enclosed with a single or multi-layer covering of protective material.

The one-piece golf ball and the solid core for a multi-piece solid (non-wound) ball frequently are formed from a combination of materials such as polybutadiene and other rubbers cross-linked with zinc diacrylate (ZDA) or zinc dimethacrylate (ZDMA), and optionally containing fillers and curing agents. The cores are molded under high pressure and temperature to provide a ball of suitable hardness and resilience. For multi-piece non-wound golf balls, the cover typically contains a substantial quantity of thermoplastic or thermoset materials that impart toughness and cut resistance to the covers while also providing good playability and distance characteristics. Examples of suitable cover materials include ionomer resins, polyurethanes, polyisoprenes, and nylons, among others.

The wound ball is frequently referred to as a "three-piece" ball since it is produced by winding vulcanized rubber thread under tension around a solid or semi-solid center to form a wound core. The wound core is thereafter enclosed in a single or multi-layer covering of tough protective material. For many years the wound ball satisfied the standards of the U.S.G.A. and was desired by many skilled, low handicap golfers.

The three piece wound ball typically has a cover comprising balata, ionomer or polyurethane like materials, which is relatively soft and flexible. Upon impact, it compresses against the surface of the club producing high spin. Consequently, the soft and flexible covers along with wound cores provide an experienced golfer with the ability to apply a spin to control the ball in flight in order to produce a draw or a fade, or a backspin which causes the ball to "bite" or stop abruptly on contact with the green. Moreover, the cover produces a soft "feel" to the low handicap player. Such playability properties of workability, feel, etc., are particularly important in short iron play and at low swing speeds and are exploited significantly by highly skilled players.

However, a three-piece wound ball has several disadvantages. For example, a soft wound (three-piece) ball is not well suited for use by the less skilled and/or medium to high handicap golfer who cannot intentionally control the spin of the ball. In this regard, the unintentional application of side spin by a less skilled golfer produces hooking or slicing. The side spin reduces the golfer's control over the ball as well as reduces travel distance. Consequently, the impact of an unintentional side spin often produces the addition of unwanted strokes to the golfer's game.

The above described golf balls are produced by various golf ball manufacturers to be generally uniform in consistency. In essence the different layers are designed to be uniform in composition and the covers or centers are essentially perfectly centered. The center of gravity ("COG") of these commercial balls is very desirably at the center point of the ball.

Unlike the conventional balls briefly described above, the balls of the present invention are not uniform in consistency. The balls of the invention have been specifically designed to produce a controlled weight distribution about a designated spin axis. In this regard, the subject golf balls of the invention utilize different density regions or gradients positioned at various locations within one or more layers of the balls. It has been found that this selectively controlled weight distribution imparts a spin stabilization effect about the ball's spin axis. Such a selected weight distribution also corrects the undesired side spin that is produced when the ball is incorrectly struck or mishit with a golf club.

In this regard, when a ball is properly struck, the ball will rise in flight towards the intended direction of travel. This is due to the transformation of forces from the club to the ball and the lift produced by the ball which is back spinning in the air.

Specifically, after being properly struck, the ball will spin about an axis horizontal to the ground ("horizontal axis") such that the bottom of the ball moves in the direction of flight and the top moves opposite to the direction of travel. This results in the ball back spinning in the air in the direction of travel about an axis of rotation or spin axis. As the ball spins (i.e. backspins) in flight, the ball lifts into the air. The addition of dimples or surface depressions in the ball surface further increase the lifting forces by creating localized areas of turbulence.

However, when a ball is improperly struck (i.e. the club face is not traveling in the same direction that it is desired for the ball to take), a side spin is also imparted on the ball. When this occurs, the ball is forced to one side or another of a desired flight path resulting in a curved flight known as "hook" or "slice." Such a curved flight pattern is generally undesirable by the average golfer.

Accordingly, the present invention is directed to improved golf ball components and golf balls employing the same, which have a weight distribution that produces a preferred spin axis. The preferred spin axis is perpendicular to a gyroscopic center plane and corrects side spin imparted by striking the ball with an open or closed club face. These and other objects and features of the invention will be apparent from the following summary of the invention, description of the preferred embodiments, the drawings and from the claims.

SUMMARY OF THE INVENTION

In one aspect, the present invention is directed to a golf ball comprising at least one high-density region centered about the spin or rotational axis of the ball. The region is positioned in the ball along the ball's gyroscopic center plane. The center plane is perpendicular to the desired or designated spin or rotational axis of the ball.

In this regard, it is rare during play that a golf ball exhibits pure backspin (rotation about a horizontal axis in flight) or pure sidespin (rotation about a verticle axis in flight). Instead, the actual spin of a ball during flight is a combination of these spin characteristics. Consequently, during flight, a golf ball will typically spin about a tilted axis that is oriented at some angle.

In the present invention, the ball will produce a stabilized spin in flight, even if mishit. By utilizing a controlled weight distribution, the ball will reorient its spin pattern in flight.

Moreover, in another aspect, the ball can be oriented on the tee to produce a stable spin axis. For example, the ball can be oriented on the tee so that the spin axis is perpendicular to the line of flight or intended target. If the club strikes the ball in an open or closed position creating unintentional side spin, the controlled weight distribution of the ball will correct the side spin and reorient the rotation of the ball so that it rotates on its intended spin axis.

Alternatively, regardless of the initial orientation of the ball prior to striking with a club, once a sufficient spin rate is achieved the ball will reorient itself until the spin axis is perpendicular to the desired direction of travel. Consequently, regardless of how the ball is played on the tee, the ball will seek and find the same horizontal spin axis each time it leaves the club face.

Additionally, the ball of the invention produces enhanced distance. Specifically, the C.O.R. of the ball is increased as excess weighting material compounded into the core is removed and repositioned by alternative materials.

In another aspect, the invention relates to a golf ball having a core, a cover or multiple components comprising a continuous band or region along the component's longitudinal axis formed of a material having a higher density than the remaining regions of the component core. The high density band or region is positioned about the ball's spin axis in such a manner as to provide a gyroscopic center plane. Alternatively, the continuous band can be replaced with a plurality of discrete, spaced apart weighted regions which are also positioned about the ball's spin axis to produce a gyroscopic center plane.

In a further aspect, the present invention is directed to a golf ball having a core comprising a body and a channel extending around the circumference of core along a common plane. The channel is filled with a material having a higher density than the body of the core. The channel is positioned in the core about the ball's spin axis in such a manner to produce a gyroscopic center plane. In the alternative, the material in the channel can be non-continuous and spaced apart along the ball's gyroscopic center plane to produce a spin stabilization affect.

Additionally, the core can also define a series of equally spaced apart cavities that extend along a common plane. These cavities are filled with material having a higher specific gravity than the body of the core. This unique configuration imparts to the ball a stabilization gyroscopic characteristic. That is, regardless of the initial orientation of the ball prior to striking with a club, once struck, the axis of rotation of the ball will change until the axis is perpendicular to the common plane within which the cavities are aligned. This gyroscopic characteristic is beneficial in that it stabilizes the spinning ball and greatly reduces the tendency for the ball to hook or slice.

In a further aspect, the present invention concerns a method for making a golf ball and/or utilizing the ball of the invention to improve play.

BRIEF DESCRIPTION OF THE DRAWINGS

The following is a brief description of the drawings, which are presented for the purposes of illustrating the invention and not for the purposes of limiting the same.

DETAILED DESCRIPTION OF THE PREFERRED EMBODIMENTS

Figure 2:
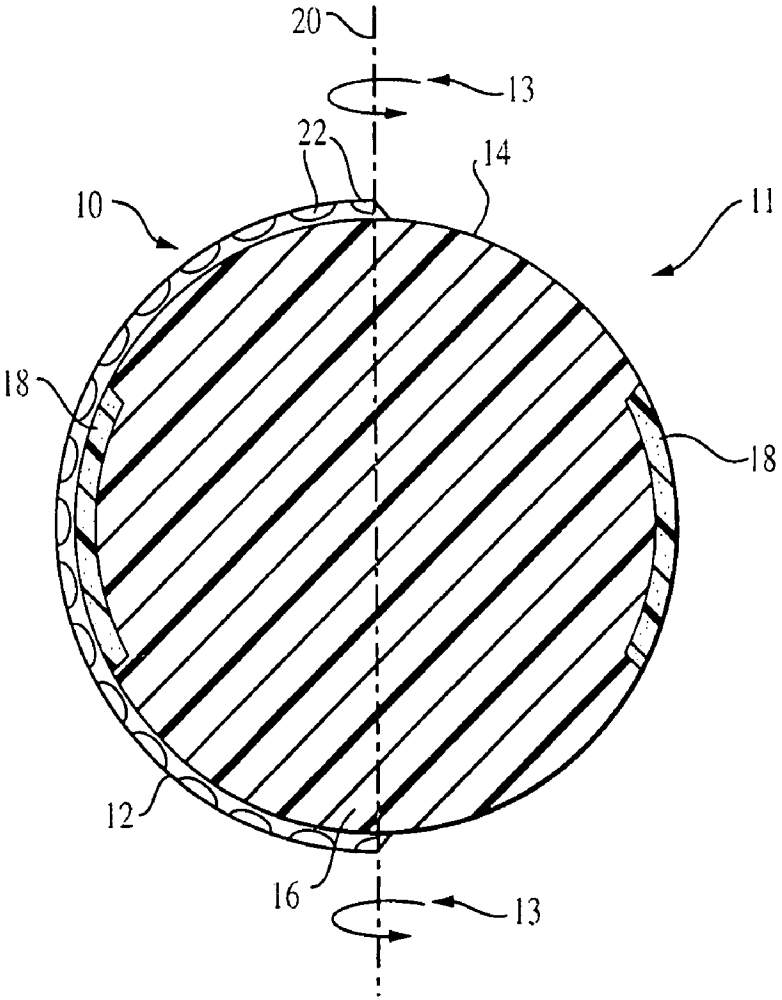
FIG. 2 is a sectional view taken along the lines 2—2 in FIG. 1 showing the lower cross-section of the ball of FIG. 1.

The present invention relates to improved components for golf ball construction and the resulting golf balls produced therefrom having controllable flight characteristics. Specifically, according to the invention, golf balls having improved spin stability are provided. The subject golf balls have a high-density material in at least one component or layer that is selectively distributed to provide a spin-stabilizing, gyroscopic center plane.

The golf balls of the present invention optionally conform to limitations such as size, weight, and others, for example, as specified by the United States Golf Association (USGA), or in accordance with other promulgated or de facto standards. However, since several embodiments of the self-correcting golf ball of the subject invention are particularly beneficial to beginning and average golfers, it is also advantageous to such golfers that these embodiments be made in excess of USGA or other standards. For example, in certain embodiments where increased distance is desired, the subject golf ball can be optionally made in excess of the USGA maximum weight and/or be of a smaller than standard size.

The term or designation "m×n" or "m×n construction," as used herein, refers to a golf ball construction wherein m is the number of central core components or layers and n is the number of cover components or layers. Thus, a 1×1 construction refers to a golf ball construction having a single core component and a single cover layer. A 2×2 construction refers to a golf ball construction having two core components, e.g., a first or central core component or layer and a second core layer disposed about the first core component, and two cover components, e.g., a first or inner cover layer and a second or outer cover layer. The present invention may include any combination wherein m and n, which may be the same or different. Such constructions include, for example, 1×0 (i.e. a unitary ball), 1×1, 1×2, 2×1, 2×2, 1×3, 3×1, 2×3, 3×2, 3×3, 1×4, 4×1, 2×4, 4×2, 3×4, 4×3, 4×4, and so on.

The golf balls of the present invention utilize a selected weight distribution which provides a gyroscopic center plane that stabilizes the spin about a spin axis perpendicular to the center plane. In certain embodiments, the high-density material is applied in various configurations to form high-density regions or longitudinal bands of material which are centered about an equatorial plane of the golf ball. The high density regions or longitudinal bands of material form a gyroscopic center plane of the ball.

In other embodiments, the high-density material is applied to form high-density polar regions of the golf ball, which are symmetrically disposed on opposite sides of an equatorial plane of the golf ball, the equatorial plane forming a gyroscopic center plane of the ball. In still further embodiments, the high-density material is applied in both a longitudinal axis band and polar regions. The high-density material is incorporated into the selected region or regions of at least one core layer and/or at least one cover layer of the golf ball.

As used herein, the term "high-density material" refers to materials having relatively high densities, i.e., that are heavy or have a specific gravity greater than the base polymeric material of the golf ball component. Preferably, the high-density materials have a specific gravitygreaterthan 1.0, more preferably greater than 2.0, and most preferably greater than 4.0.

The golf balls of the present invention utilize a core which comprises a single core component or layer, or a multi-layer core configuration having two or more core layers. A cover comprising one or more layers is subsequently molded about the core component to form a solid, non-wound golf ball. The high-density regions are formed of various configurations within any one or more of the core and cover layers.

Figure 1:
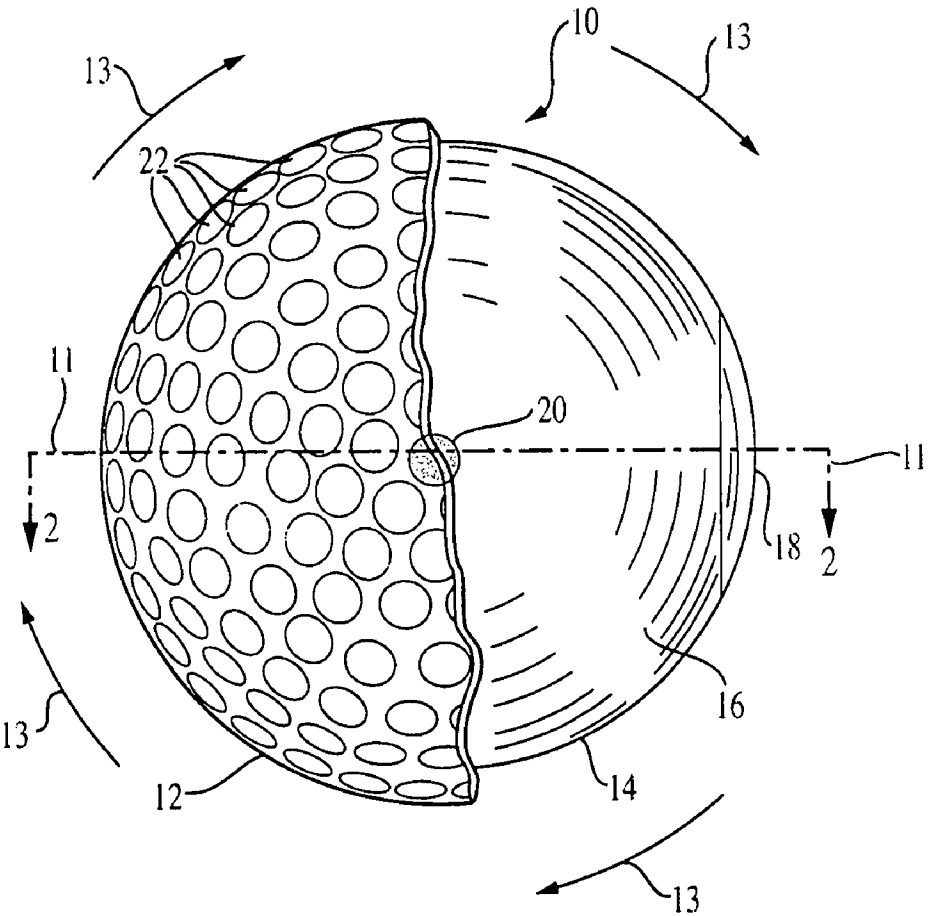
FIG. 1 is a partial cutaway view of a two-piece golf ball in accordance with the present invention comprising a core having oppositely disposed high-density polar regions.

Referring now to the FIGURES, wherein like reference numerals are used to denote like or analogous components throughout the several views, FIGS. 1 and 2 illustrate a 1×1 golf ball construction 10 in accordance with a first illustrated embodiment of the present invention. The golf ball 10 comprises a single-layer cover 12 disposed over a single-component core 14, the cover having a plurality of dimples 22 formed on the outer surface thereof.

The core 14 comprises a main body 16 having high-density polar regions 18 disposed at the periphery on opposite sides of the core body 16. These two weighted regions 18 are symmetric about a spin axis 20 of the golf ball which extends out of the plane towards the viewer of FIG. 1. The regions 18 produce a gyroscopic effect when struck with a club head (not shown) generally along the gyroscopic center plane 11. This gyroscopic effect results in a stable back spin (shown as 13) about an axis 20 perpendicular to the center plane 11 (also represented by the lines 2—2 in FIG. 1).

The ball shown in FIG. 1 corrects for side spin, which is often unintentionally imparted to the ball when the ball is struck with the club face either open (which causes slicing of a conventional golf ball) or closed (which causes hooking of a conventional golf ball), since the ball will tend to revert to the stable, gyroscopic spin axis during spin decay.

FIG. 2 is a cross-sectional view along the lines of 2—2 in FIG. 1 showing the bottom half of the ball. This cross-section is also representative of the gyroscopic center plane 11. The spin axis 20 is shown to extend through the geometric center of the ball in FIG. 2. At first when the ball is struck by a club head (not shown) the ball will spin about various axes caused by the deviation of the center of gravity, the geometrical center of the ball, etc. However, shortly thereafter due to the positioning of the high-density materials 18 in the gyroscopic center plane 11, the ball will spin backwards 13 about a steadying axis 20, thereby reducing any side spin.

The weighted regions 18 are formed of a material having a higher density relative to the core body 16 such as a metal, or may be formed of a composite material produced by the selective incorporation of a high-density material therein. In one embodiment, the high-density material is a malleable, moldable, or castable material having a higher density than the body 16 of the core. Alternatively, the high-density material is employed in the form of particles of one or more high-density materials incorporated into a polymeric matrix material, which may be the same as or different than the polymer employed in the core body 16. Irrespective of the material used to form the high-density regions, the core 14 can be produced by a number of methods.

For example, in a first general method, the dense regions 18 can be separately formed members. A solid core body 16 is also separately formed and cured, e.g., using a method as described in more detail below. The solid core body 16 and the polar regions 18 may be adhesively fastened or bonded together and complimentary in shape such that together they form a spherical core member 14. The complimentary shape of the core body 16 can be achieved by molding to the desired final shape, or alternatively, providing a spherical member and selectively removing material to achieve the desired shape, e.g., by cutting, ablation, abrasion, and the like.

In a second general method of forming the core 14, the regions 18 are first separately formed. The solid core body 16 is then formed in a comolding process. A mold which produces a spherical core 14 can be used, or alternatively, hemispherical molds can be used, with gravity advantageously being used to centrally locate the dense region 18. The hemispheres are then fastened or bonded to the core 14.

In a third general method of forming the core, the core body 16 and the dense polar regions 18 are formed at the same time in a single molding process, for example, by selective lay up or placement of high-density material in a mold.

Again, the high-density material can be in the form of either a solid or composite material which is molded or cast in the desired pattern, for use with a separately molded core body 16 or to be used in a comolding process. When the high-density region is a composite, a particulate or fibrous material is incorporated as a filler material in a matrix material in the desired regions. The particles may be in the form of powders, granules, flakes, fragments, fibers, whiskers, chopped fibers, milled fibers, and so forth. This is described further in more detail below.

Exemplary high-density materials which may be incorporated in accordance with the present invention to produce the desired weight distribution include, but are not limited to, metals or metal alloys (such as solid, powder or other form of bismuth, boron, brass, bronze, cobalt, copper, inconel metal, iron powder, molybdenum, nickel, stainless steel, tungsten powder, titanium powder, aluminum and the like), metal coated filaments (such as nickel, silver, or copper coated graphite fiber or filament and the like), carbonaceous materials (such as graphite, carbon black, cotton flock, leather fiber, etc.), aramid fibers (such as Kevlar® or other aramid fibers), alumina, aluminosilicate, quartz, rayon, silica, silicon carbide, silicon nitride, silicon carbonitride, silicon oxycarbonitride, titania, titanium boride, titanium carbide, zirconia toughened alumina, zirconium oxide, black glass ceramic, boron and boron containing particles or fibers (such as boron on titania, boron on tungsten, etc.), boron carbide, boron nitride, ceramics, glass (e.g., A-glass, AR-glass, C-glass, D-glass, E-glass, R-glass, S-glass, S1-glass, S2-glass, and other suitable types of glass), high melting polyolefins (e.g., Spectra® fibers), high strength polyethylene, liquid crystalline polymers, nylon, paraphenylene terephthalamide, polyetheretherketone (PEEK), polyetherketone (PEK), polyacrylonitrile, polyamide, polyarylate fibers, polybenzimidazole (PBI), polybenzothiazole (PBT), polybenzoxazole (PBO), polybenzthiazole (PBT), polyester, polyethylene, polyethylene 2,6 naftalene dicarboxylate (PEN), polyethylene phthalate, polyethylene terephthalate, polyvinyl halides, such as polyvinyl chloride, other specialty polymers, and so forth. Mixtures of any such suitable materials may also be employed in order to obtain the high density desired.

When a particulate high-density material is employed, the particles can range in size from about 5 mesh to about 1 micron, preferably about 20 mesh to about 325 mesh and most preferably about 100 mesh to about 1 micron.

Examples of various suitable heavy filler materials which can be used as the high-density material are listed below.

TABLE 1

| Filler Type | Specific Gravity |
|---|---|
| Metals and Alloys (powders) | |
| titanium | 4.51 |
| tungsten | 19.35 |
| aluminum | 2.70 |
| bismuth | 9.78 |
| nickel | 8.90 |
| molybdenum | 10.2 |
| iron | 7.86 |
| copper | 8.94 |
| brass | 8.2–8.4 |

TABLE 1-continued

| Filler Type | Specific Gravity |
|---|---|
| boron | 2.364 |
| bronze | 8.70–8.74 |
| cobalt | 8.92 |
| beryllium | 1.84 |
| zinc | 7.14 |
| tin | 7.31 |
| Metal Oxides | |
| zinc oxide | 5.57 |
| iron oxide | 5.1 |
| aluminum oxide | 4.0 |
| titanium dioxide | 3.9–4.1 |
| magnesium oxide | 3.3–3.5 |
| zirconium oxide | 5.73 |
| Other | |
| graphite fibers | 1.5–1.8 |
| precipitated hydrated silica | 2.0 |
| clay | 2.62 |
| talc | 2.85 |
| asbestos | 2.5 |
| glass fibers | 2.55 |
| Kevlar ® fibers | 1.44 |
| mica | 2.8 |
| calcium metasilicate | 2.9 |
| barium sulfate | 4.6 |
| zinc sulfide | 4.1 |
| silicates | 2.1 |
| diatomaceous earth | 2.3 |
| calcium carbonate | 2.71 |
| magnesium carbonate | 2.20 |
| Particulate carbonaceous materials | |
| graphite | 1.5–1.8 |
| carbon black | 1.8 |
| natural bitumen | 1.2–1.4 |
| cotton flock | 1.3–1.4 |
| cellulose flock | 1.15–1.5 |
| leather fiber | 1.2–1.4 |

The amount and type of heavy weight filler material utilized is dependent upon the overall characteristics of the self-correcting golf ball desired. Generally, lesser amounts of high specific gravity materials are necessary to produce a desired weight distribution in comparison to low specific gravity materials. Furthermore, other factors, such as handling and processing conditions, can also affect the type and amount of heavy weight filler material incorporated into the high-density regions.

The term "density reducing filler" as used herein refers to materials having relatively low densities, i.e., that are lightweight or have a specific gravity less than the specific gravity of the base polybutadiene rubber of 0.91. Examples of these materials include lightweight filler materials typically used to reduce the weight of a product in which they are incorporated. Specific examples include, for instance, foams and other materials having a relatively large void volume. Typically, such filler materials have specific gravities less than 1.0. A density-reducing filler can be used in other ball components to offset the weight increase due to the dense material in regions 18, such as when it is desired to provide a golf ball which is in conformance with weight restrictions. The density-reducing filler can also be used to adjust one or more desired properties, such as the MOI, COR, and others.

Figure 3:
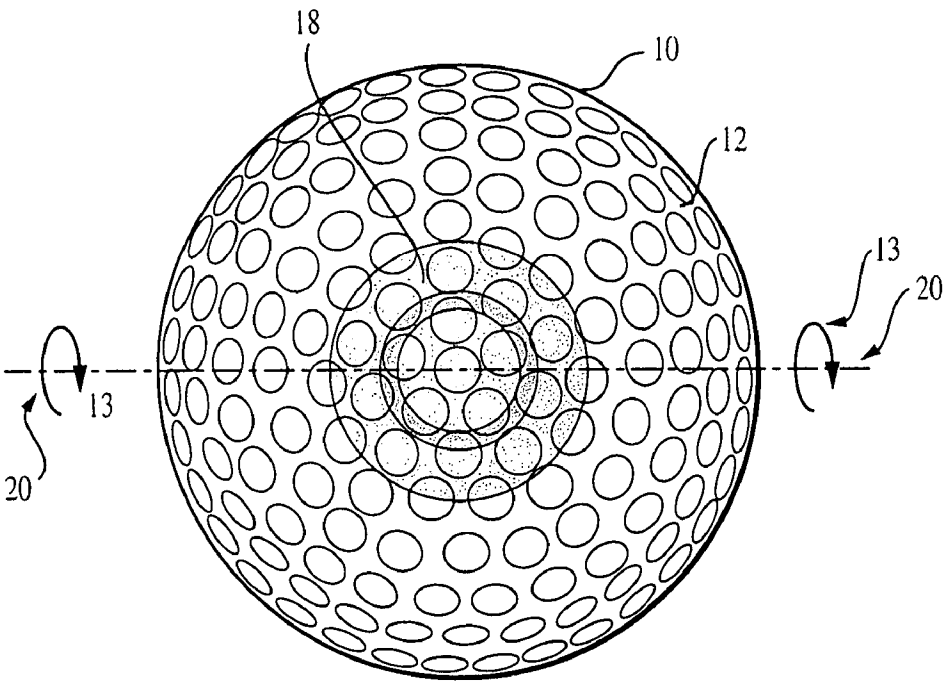
FIG. 3 is a side view of an embodiment of the invention shown in FIGS. 1 and 2 with a translucent cover.

FIG. 3 illustrates a further variation of the embodiment shown in FIGS. 1 and 2, wherein the cover 12 is formed of a transparent or translucent material through which differentially-colored high-density regions 18 (such as a "bulls-eye") are viewable. In this embodiment, a golfer is able to readily align the ball on the tee or putting green so that the spin axis 20 is aligned horizontally pointed to the golfer and the gyroscopic plane 11 is parallel with the intended direction of ball travel. That is to say, the gyroscopic center plane is perpendicular to the plane of the club face and the spin axis 20 is aligned horizontally pointing towards the golfer. By placing the ball on the tee with the spin axis 20 directed horizontally towards the golfer and the plane of the ball formed by the high density regions (or gyroscopic plane 11) is perpendicular to the club face, the ball, when properly struck, will rotate in a backwards 13 direction about the spin axis 20. This reduces the chances of the ball slicing or hooking by creating spin stabilization.

Alternately, an opaque cover 12 is provided and the gyroscopic center plane is determined, e.g., by rotating the ball until it reaches a stable spin state, by x-ray or other imaging device. Once the gyroscopic center plane 11 is determined, markings or indicia are printed on the cover to indicate the proper ball alignment. Such markings may include, for example, markings which correspond to the locations of the underlying dense polar regions 18, a printed longitudinal axis band aligned with the gyroscopic center plane 11, a logo or textual indicia which, when placed in a specified orientation, will result in correct alignment of the ball, and so forth. Alternatively, the position of the spin axis 20 may also be so identified in order to demonstrate the proper alignment of the ball.

Figure 4:
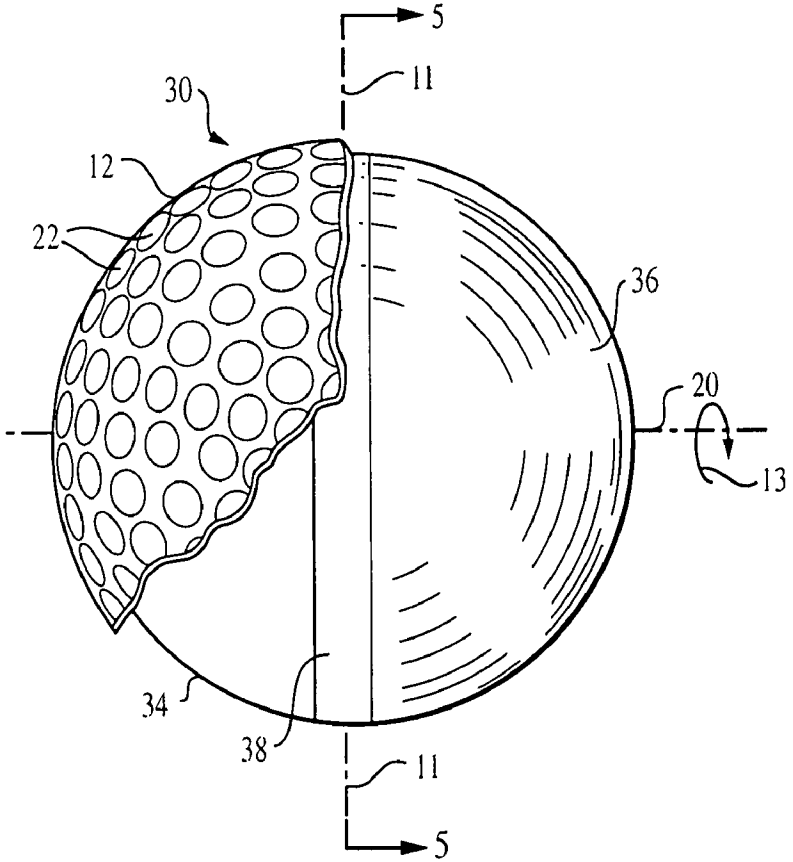
FIG. 4 is a partial cutaway view of a golf ball in accordance with another embodiment of the present invention comprising a core having a band or region along its longitudinal axis formed of a material having a higher density than the remaining regions of the core.
Figure 5:
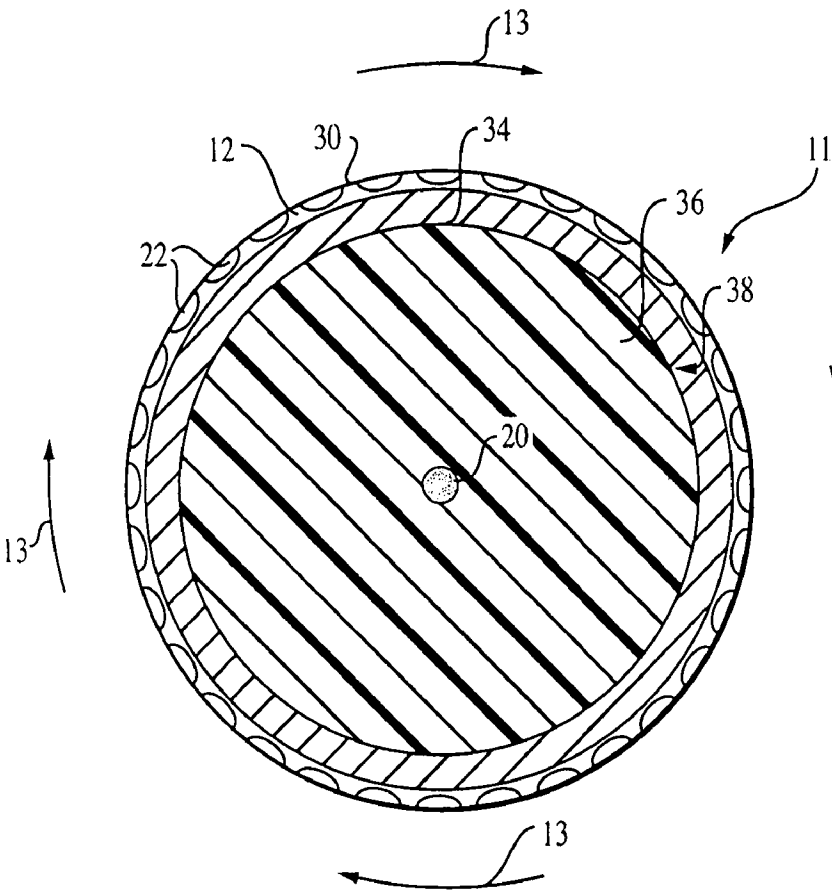
FIG. 5 is a side sectional view taken along the lines 5—5 in FIG. 4.

Referring now to FIGS. 4 and 5, there appears a 1×1 golf ball construction 30 according to an additional preferred embodiment of the present invention. FIG. 5 is representative of the right half of the ball of FIG. 4. This preferred embodiment golf ball 30 comprises a cover 12 disposed over a core 34, the cover having a plurality of dimples 22 formed on the outer surface thereof. The core 34 comprises a main body 36 and a peripheral, high-density longitudinal axis band 38 which is aligned with a gyroscopic center plane 20. The band 38 is centered about the spin axis 20 of the golf ball to produce a spin-correcting gyroscopic effect. In FIG. 5, spin axis 20 extends into and out of the plane towards the viewer of the cross-sectioned ball. The weighted region 38 is formed of a high-density solid or composite material as described above.

Again, the core 34 can be constructed by a number of methods. The band 38 can be separately formed, for example, as a molded or extruded strip or dense material, and then applied to a separately formed core body 36 which has a longitudinal recess shaped to receive the strip of high-density material. The strip or band and the core body are complimentary in shape such that a spherical core is produced. The recess in the core body can be formed from a spherical core produced as described above by material removal, such as cutting, ablation, abrasion, and so forth. Alternately, the recess can be formed during the molding process using an appropriately shaped mold.

In another method of making the core 34, the longitudinal band is separately formed as above, and then the core 38 is produced by comolding the core body therewith. In yet another embodiment, the high-density region 38 and the core body 16 are formed at the same time by selective incorporation of high-density material when the core composition is in an uncured or partially cured state. Alternative methods for incorporating high density region(s) along a gyroscopic center plane are also possible as known by those skilled in the art and are included herein by reference.

Figure 6:
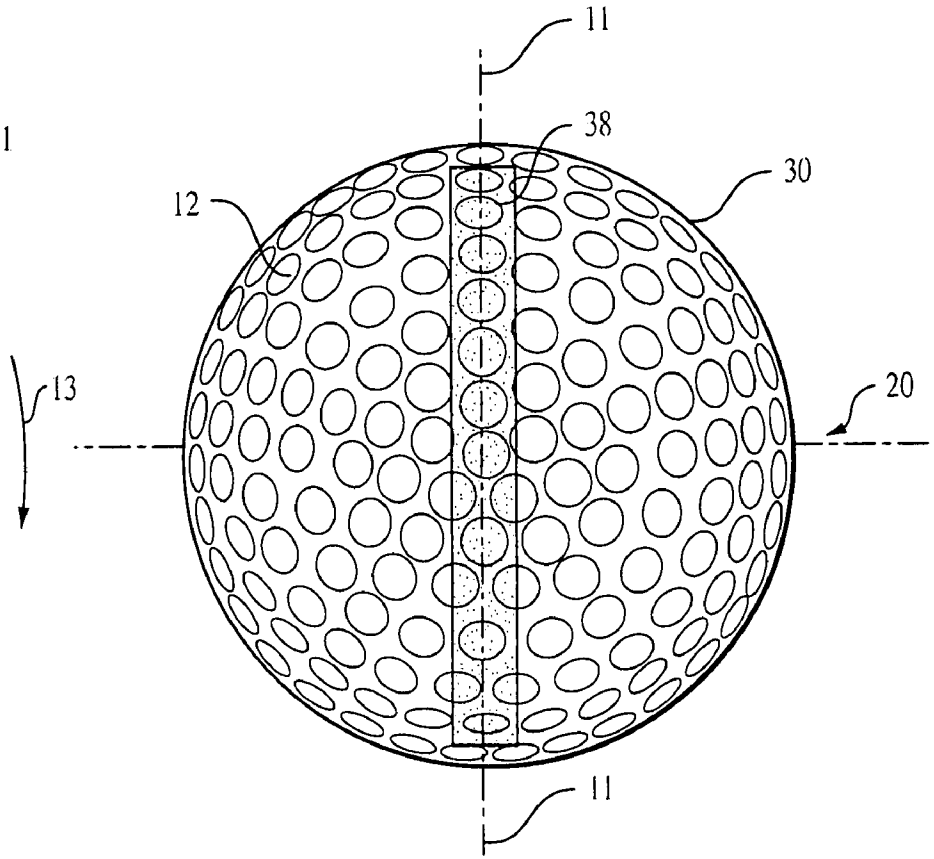
FIG. 6 is a front view of an embodiment of the invention shown in FIGS. 4 and 5 with a translucent cover.

Referring now to FIG. 6, there is shown a front view of the golf ball 30 of FIGS. 4 and 5, wherein the longitudinal axis band 38 is visible through a clear or translucent cover 12. The longitudinal axis band 38 is positioned about the ball's spin axis 20 and along its gyroscopic center plane 11. Again, an opaque cover 12 is alternatively provided with markings or indicia to assist the golfer in aligning of the ball as described above.

Figure 7:
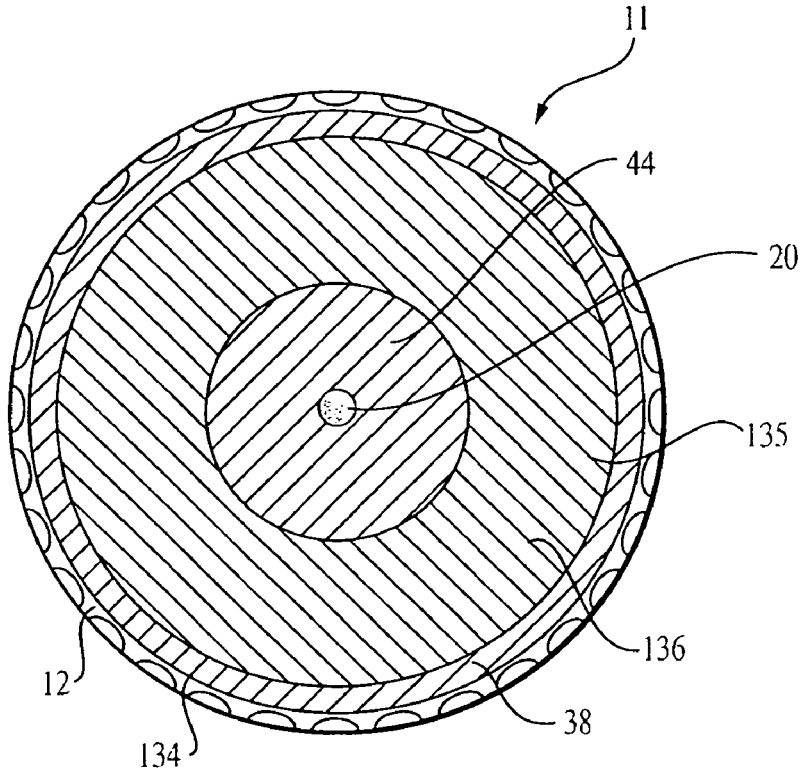
FIG. 7 is a side sectional view of an embodiment similar to the embodiment of FIGS. 4–6, having a multilayer core component and a single cover layer, wherein the high density region is formed in the outer layer of the core.

Referring now to FIG. 7, there is shown a 2×1 golf ball embodiment of the present invention which differs from the embodiment of FIGS. 4–6 in that it employs a multi-layer core 134. In this and other embodiments herein utilizing a multilayer core, a dual or two-layer core will be illustrated solely for the sake of brevity and ease of exposition. However, it will be recognized that cores having other numbers of layers, such as 3, 4, 5, etc., can be used and are within the scope of the present invention. The multi-layer core 134 includes an inner core layer 44, and an outer core layer 135 comprising a core body 136 and a high-density region 38 forming a longitudinal band thereabout. The weighted band 38 forms a gyroscopic center plane that is centered about spin axis 20 as described above. The multi-layer core 134 is covered with a cover layer 12.

Figure 8:
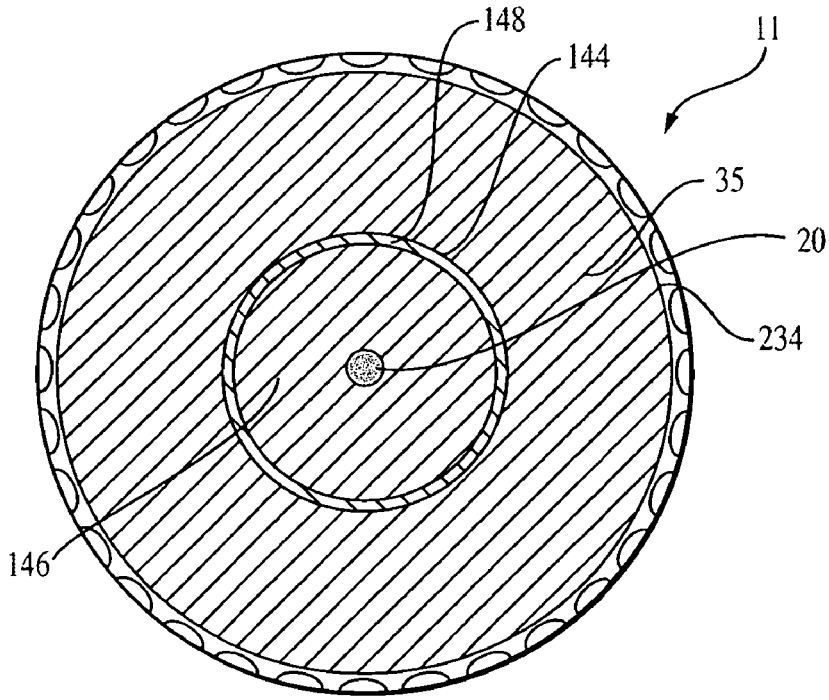
FIG. 8 is a cross sectional view illustrating another embodiment golf ball of the invention having a multilayer core, wherein a band of weighting material in the high density region is formed on an inner core layer.

Referring now to FIG. 8, there appears another 2×1 embodiment of the present invention which is similar to the embodiment of FIG. 7, but wherein a high-density region 148 is disposed on the inner core layer. A multi-layer core 234 includes an inner core layer 144, and an outer core layer 35 formed there around. The inner core layer 144 comprises a core body 146 and a high-density region 148 forming a longitudinal band thereabout. The weighted band 148 forms a gyroscopic center plane 11 centered about spin axis 20 as described above. The multi-layer core 234 is covered with a cover layer 12.

Figure 9:
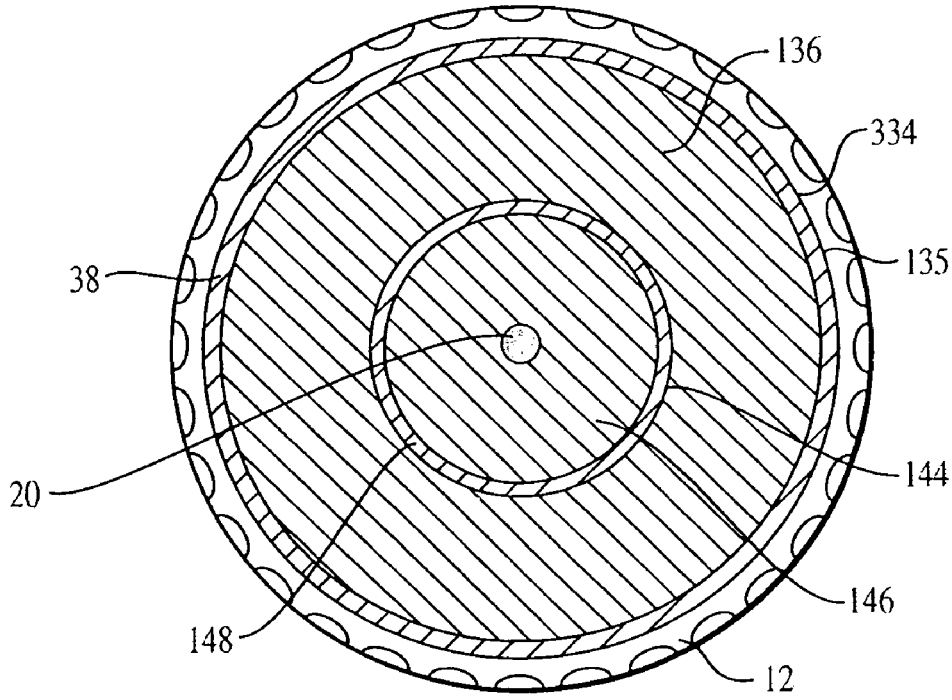
FIG. 9 is a cross sectional view illustrating a further embodiment of the golf balls of the present invention having a multilayer core, wherein a band of weighting material is formed in each of the core layers.

FIG. 9 illustrates another 2×1 embodiment, combining the features of FIGS. 7 and 8, i.e., having weighted bands in each of the multiple core layers. A multi-layer core 334 includes an inner core layer 144, and an outer core layer 135 formed there around. The inner core layer 144 comprises a core body 146 and a high-density region 148 forming a band thereabout. The weighted band 148 forms a gyroscopic center plane (not shown) and is centered about spin axis 20 as described above. The outer core layer 135 comprises a core body 136 and a high-density region 38 forming a band which is aligned with the center plane. The multi-layer core 334 is covered with a cover layer 12.

In each of the above-described embodiments, the weighted region(s) forms a continuous longitudinal band around the spin axis 20. In further embodiments, the band is replaced with discrete weights spaced along the longitudinal plane of the golf ball.

Figure 10:
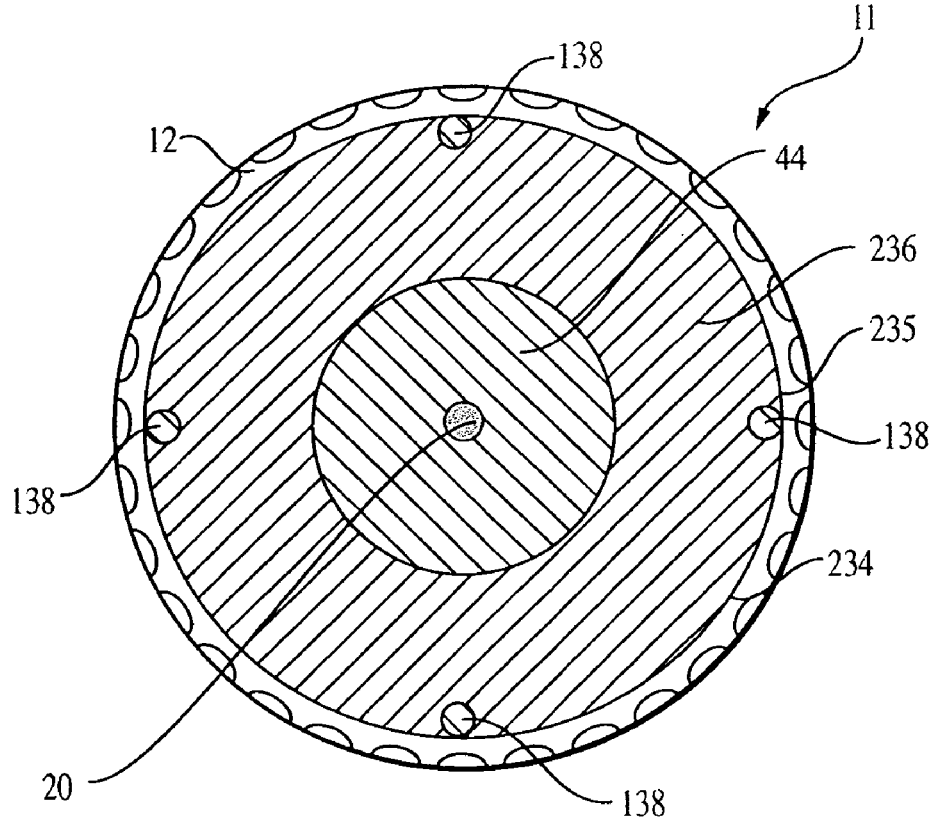
FIG. 10 is a cross section view of an additional embodiment of the invention, wherein a plurality of discrete, spaced apart weighted regions are present in the outer core layer. These regions are also positioned in such a manner as to produce a gyroscopic center plane.

Referring now to FIG. 10, a 2×1 golf ball includes a multi-layer core 234, which includes an inner core layer 44 and an outer core layer 235. The outer core layer 235 comprises a core body 236 and multiple high-density regions 138 circumferentially and equally spaced along the longitudinal axis of the core body, thus defining a gyroscopic plane 11 in much the same manner as the continuous bands described above. The number of discrete weights 138 is 2 or more (4 in the illustrated exemplary embodiment), preferably from 3 to 12. The multi-layer core 234 is covered with a cover layer 12. Preferably, the weighted regions 138 are preformed metal or other high-density bodies which are placed in an accommodating recess formed on the core body 236.

In a preferred embodiment, high-density members 138, e.g., metal shot, ball bearings, and the like, are placed in recesses, e.g., drilled cavities, of like diameter formed on a finished core body. However, weighted members of other shapes, such as discs, cylinders, cubes, and the like, are also contemplated. As an alternative to employing preformed weights, the use of a high-density doping material in a segmented band is also contemplated.

In an embodiment not shown, the golf ball of FIG. 10 is modified to employ a single layer core analogous to the embodiment of FIGS. 4–6, i.e., wherein inner core layer or component is eliminated.

Figure 11:
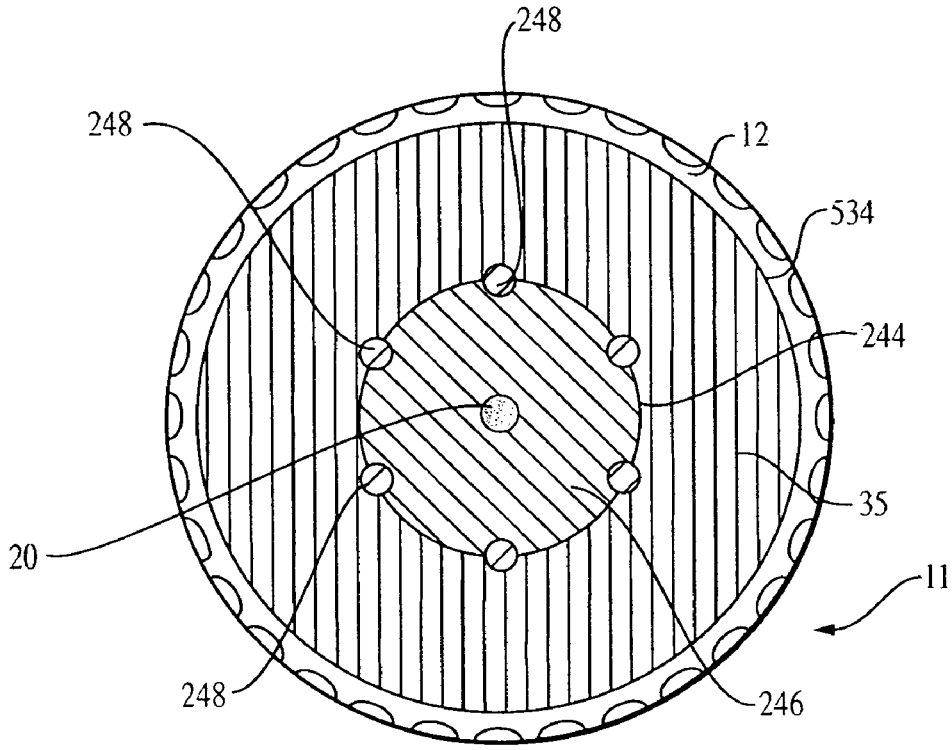
FIG. 11 is a sectional view illustrating an embodiment of the golf ball of the present invention having discrete weighted regions disposed in an inner core layer of a multilayer core golf ball construction in such a manner as to form a gyroscopic center plane.

In FIG. 11, there is shown an embodiment similar to the embodiment of FIG. 10, but wherein the weights are disposed in the inner core. A 2×1 golf ball embodiment includes a multi-layer core 534, which includes an inner core layer 244 and an outer core layer 35. The inner core layer 244 comprises a core body 246 and multiple (2 or more; 6 in the illustrated embodiment) high-density regions 248 circumferentially and equally spaced along the longitudinal axis of the inner core body, aligned with and defining a gyroscopic plane 11. It is not necessary that the weighted regions be flush with the component on which they are carried. In the illustrated embodiment, the weights are positioned in and around the inner core body. Recessing the weights is also contemplated. The multi-layer core 534 is covered with a cover layer 12.

Figure 12:
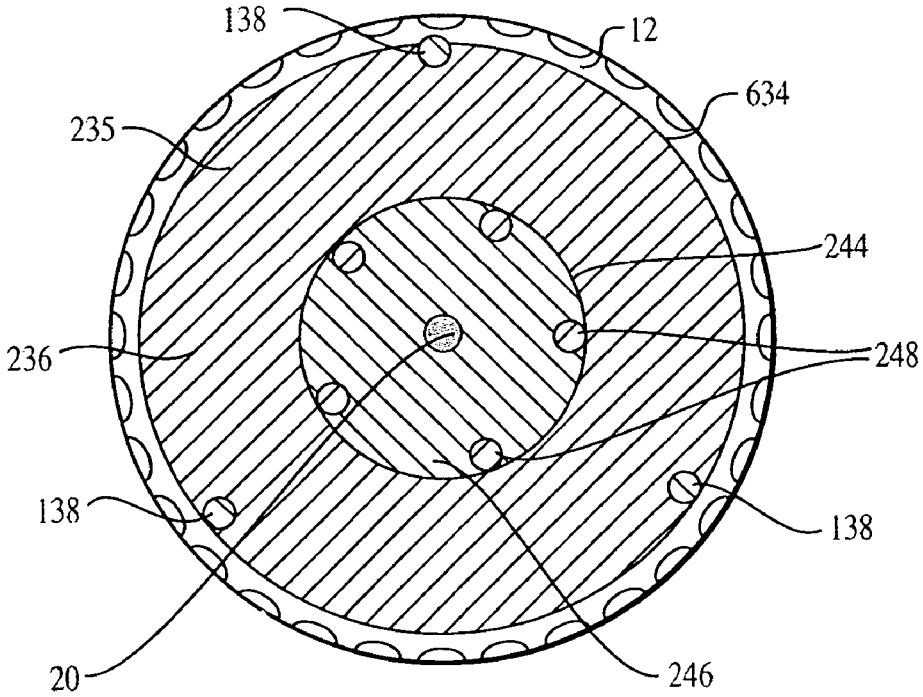
FIG. 12 illustrates an embodiment of the golf ball having discrete weighted regions forming a gyroscopic center plane (not shown) disposed in the inner and outer core layers of a multilayer core golf ball construction.

FIG. 12 depicts a further 2×1 embodiment golf ball which combines the features of the embodiments of FIGS. 10 and 11. The golf ball includes a multi-layer core 634, which includes an inner core layer 244 and an outer core layer 235. The inner core layer 244 comprises a core body 246 and 2 or more (5 in the illustrated embodiment) high-density regions 248 circumferentially and equally spaced along a longitudinal axis of the inner core body, aligned with and defining a gyroscopic plane. The outer core layer 235 comprises a core body 236 and multiple high-density regions 138 (3 in the depicted embodiment) circumferentially and equally spaced along an equator of the core body, also aligned with the gyroscopic plane. In the illustrated embodiment, the weights are positioned in and around the outer core body, however, flush or recessed placement of the weights is also contemplated. The multi-layer core 634 is covered with a cover layer 12.

Figure 13:
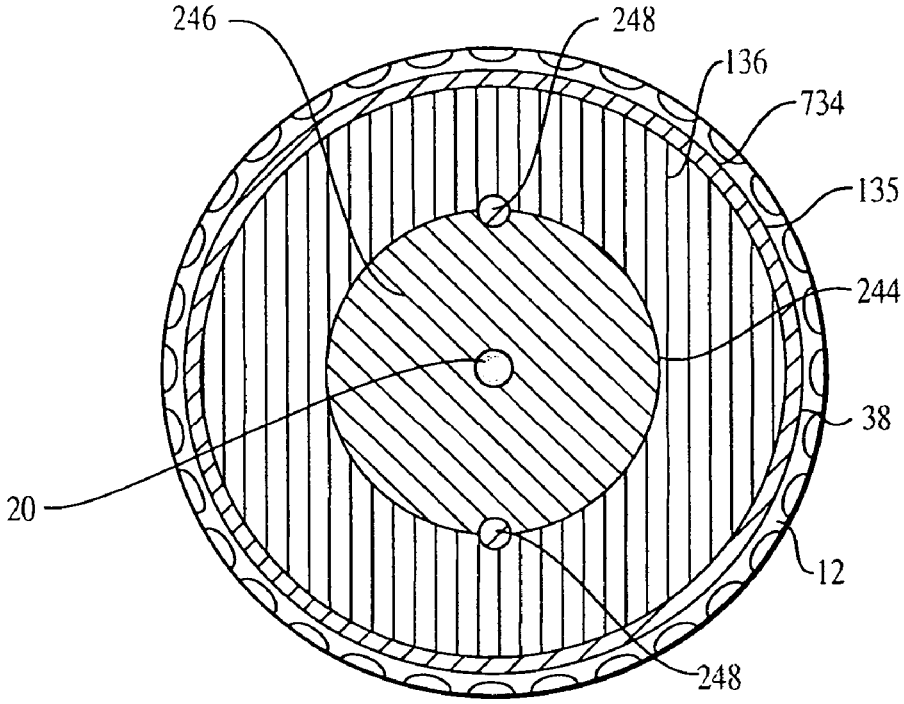
FIG. 13 is a cross sectional view illustrating an embodiment of the golf ball of the present invention having a high-density band or region of material in the outer core layer and multiple discrete high density or weighted regions in an inner core layer. The regions are positioned in such a manner as to form a gyroscopic center plane (not shown).

It will be further recognized that the various features of the depicted and described embodiments can be combined in various ways. For example, a multi-core golf ball may combine unweighted core layers, core layers having continuously weighted bands, and core layers having segmented or discrete weighting, resulting in a vast number of possibilities. As an example, FIG. 13 illustrates a golf ball of the present invention employing a 2×1 construction, and which includes a multi-layer core 734. The core 734 includes an inner core layer 244 and an outer core layer 135. The inner core layer 244 comprises a core body 246 and 2 or more (2 in the embodiment shown) high-density regions 248 circumferentially and equally spaced along a longitudinal axis of the inner core body, aligned with and defining a gyroscopic plane. The outer core layer 135 comprises a core body 136 and a high-density region 38 forming a circumferential weighted band which is aligned with the gyroscopic plane 11. The multi-layer core 734 is covered with a single cover layer 12, although multiple cover layers are also contemplated.

Figure 14:
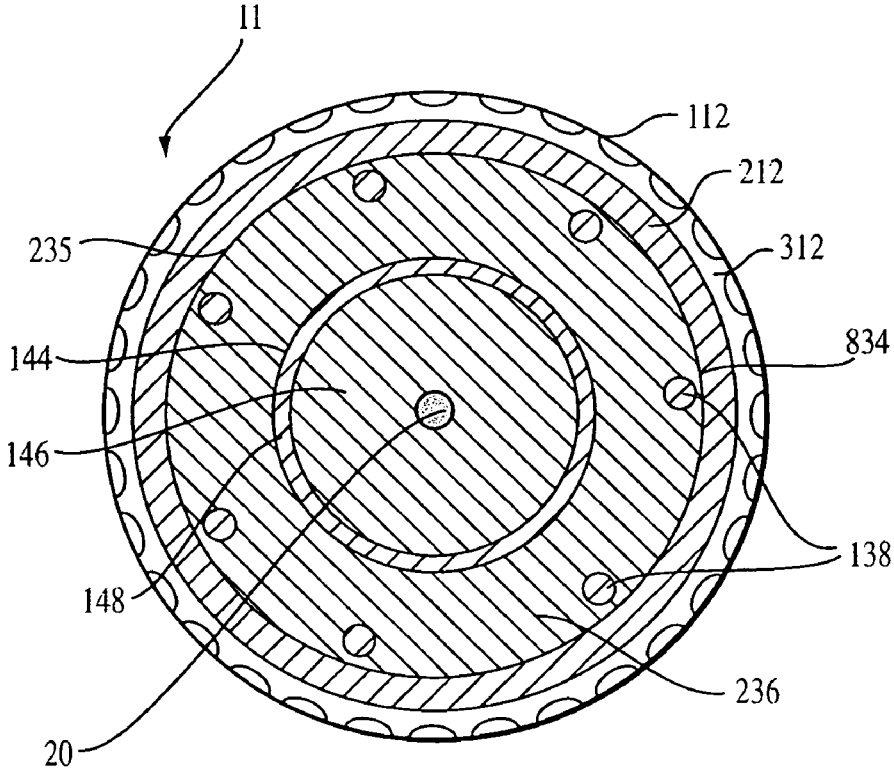
FIG. 14 shows an embodiment having a multilayer cover and a multilayer core, and having discrete weighting and continuous weighting in the outer and inner core layers, respectively. The regions are positioned in such a manner as to form a gyroscopic center plane.

Referring now to FIG. 14, there is shown an exemplary embodiment having multilayer cover. This and other illustrated embodiments having a multilayer cover herein will be depicted with a two-layer cover for the sake of brevity and ease of exposition. However, it will be recognized that the present invention is equally applicable to golf balls having multi-layer covers having other numbers of layers, such as 3, 4, 5, etc. In this embodiment, a golf ball of the present invention employing a 2×2 construction is shown, including a multi-layer cover 112 and a multilayer core 834. The core 834 includes an inner core layer 144 and an outer core layer 235. The inner core layer 144 comprises a core body 146 and a high-density longitudinal band 148 about the inner core body, aligned with and defining a gyroscopic plane 11. The outer core layer 235 comprises a core body 236 and 2 or more segmented or spaced-apart high-density regions 138 (7 in the illustrated embodiment) which are aligned with and further define, along with the band 148, the gyroscopic plane 11. The multi-layer cover layer 112 comprises an inner cover layer 212 and an outer cover layer 312.

In alternative embodiments, each of the embodiments of FIGS. 1–13 are modified to include a multi-layer cover in a manner analogous to embodiment of FIG. 14. Some of the preferred embodiments, including the above described embodiments and others, are listed below in TABLE 2.

TABLE 2

| m × n | OUTER/SINGLE COVER | INNER COVER | OUTER/SINGLE CORE | INNER CODE |
|---|---|---|---|---|
| 1 × 0 | Not Present | Not Present | Continuous Band or Discrete Weighting | Not Present |
| 2 × 1 | No Weighting | Not Present | No Weighting | Continuous Band |
| 2 × 1 | No Weighting | Not Present | No Weighting | Discrete Weighting |
| 1 × 1 | No Weighting | Not Present | Continuous Band | Not Present |
| 2 × 1 | No Weighting | Not Present | Continuous Band | No Weighting |
| 2 × 1 | No Weighting | Not Present | Continuous Band | Continuous Band |
| 2 × 1 | No Weighting | Not Present | Continuous Band | Discrete Weighting |
| 1 × 1 | No Weighting | Not Present | Discrete Weighting | Not Present |
| 2 × 1 | No Weighting | Not Present | Discrete Weighting | No Weighting |
| 2 × 1 | No Weighting | Not Present | Discrete Weighting | Continuous Band |
| 2 × 1 | No Weighting | Not Present | Discrete Weighting | Discrete Weighting |
| 2 × 2 | No Weighting | No Weighting | No Weighting | Continuous Band |
| 2 × 2 | No Weighting | No Weighting | No Weighting | Discrete Weighting |
| 1 × 2 | No Weighting | No Weighting | Continuous Band | Not Present |
| 2 × 2 | No Weighting | No Weighting | Continuous Band | No Weighting |
| 2 × 2 | No Weighting | No Weighting | Continuous Band | Continuous Band |
| 2 × 2 | No Weighting | No Weighting | Continuous Band | Discrete Weighting |
| 1 × 2 | No Weighting | No Weighting | Discrete Weighting | Not Present |
| 2 × 2 | No Weighting | No Weighting | Discrete Weighting | No Weighting |
| 2 × 2 | No Weighting | No Weighting | Discrete Weighting | Continuous Band |
| 2 × 2 | No Weighting | No Weighting | Discrete Weighting | Discrete Weighting |

Figure 15:
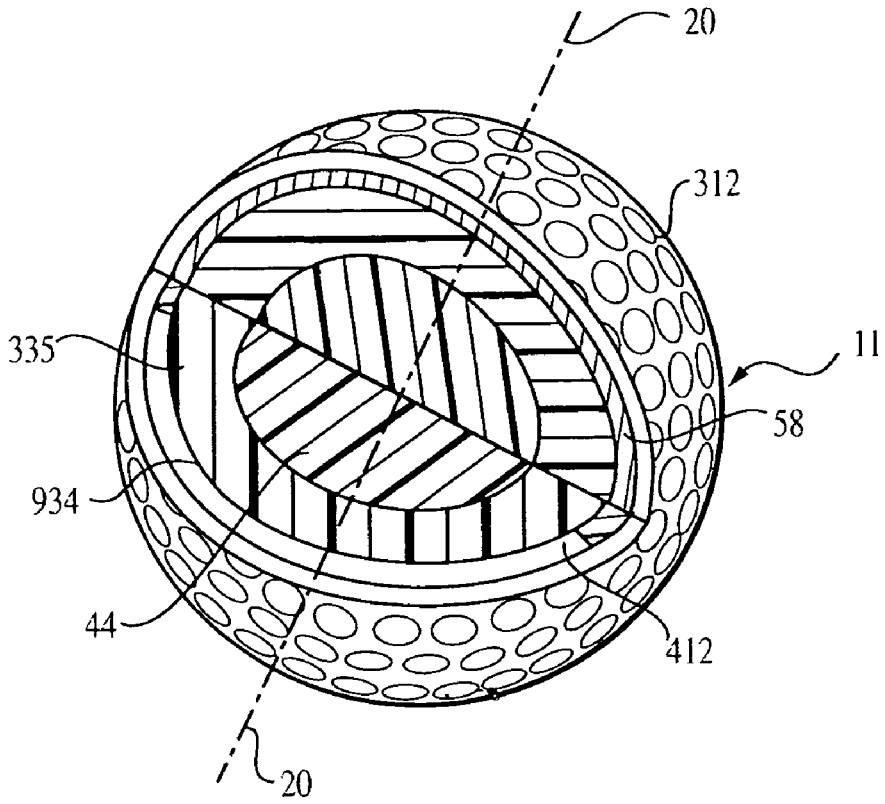
FIG. 15 is a cut-away view showing an embodiment of the present invention having a multilayer cover and a continuous weighted band of material in an inner cover layer forming a gyroscopic center plane.

FIGS. 15–26 illustrate some exemplary embodiments having multiple cover layers wherein weighting is provided in one or more of the cover layers. Referring now to FIG. 15, there is shown an exemplary embodiment having a multi-layer cover component comprising outer cover layer 312 and inner cover layer 412, which has a longitudinal band 58 of high-density material formed therein. The longitudinal band 58 is positioned about spin axis 20 and is representative of the gyroscopic center plane 11. A multi-component core 934 is illustrated, which includes an outer core layer 335 and an inner core layer 44. Alternatively, a single-component core or a core having three or more components can be used. Likewise, gyroscopic weighting of one or more of the core components, centered about the same gyroscopic center plane 11 as the band 58, can also be provided as described above.

Figure 16:
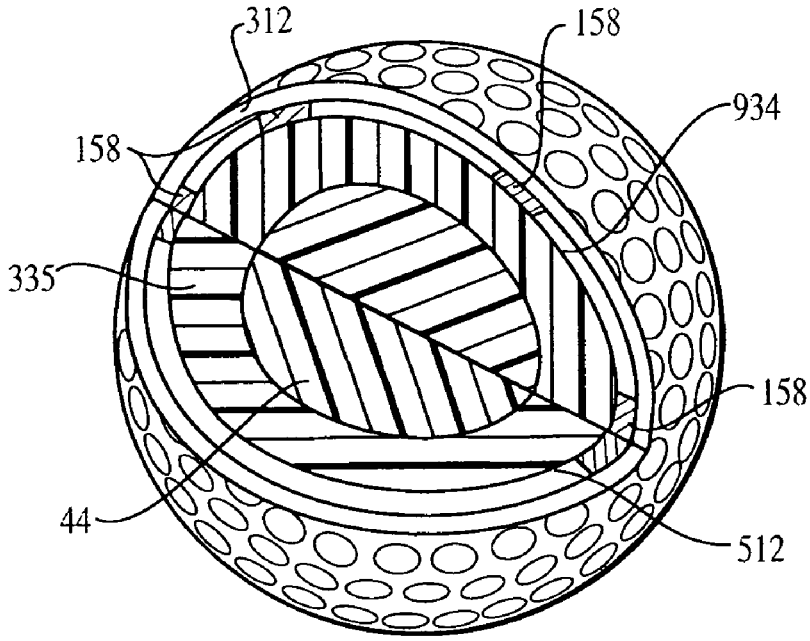
FIG. 16 shows an embodiment similar to the embodiment of FIG. 15, but wherein the weighted band is replaced by a plurality of discrete weighted segments or regions to form a gyroscopic center plane (not shown).

Referring now to FIG. 16, a golf ball embodiment appears which is similar to that shown in FIG. 15, but wherein the weighted band is replaced with a series of spaced apart, discrete weighted regions which produce a similar gyroscopic effect. Any number of weighted regions ranging from 2 or more can be utilized. The golf ball comprises a multilayer cover component comprising outercover layer 312 and inner cover layer 512, which has spaced apart weighted regions 158 of a high-density material therein formed along a longitudinal axis of the inner cover layer. Again, a multi-component core 934 is illustrated, which includes an outer core layer 335 and an inner core layer 44, although a single-component core or a core having three or more components can be used instead. Likewise, gyroscopic weighting of one or more of the core components can also be provided in the manner described above.

Figure 17:
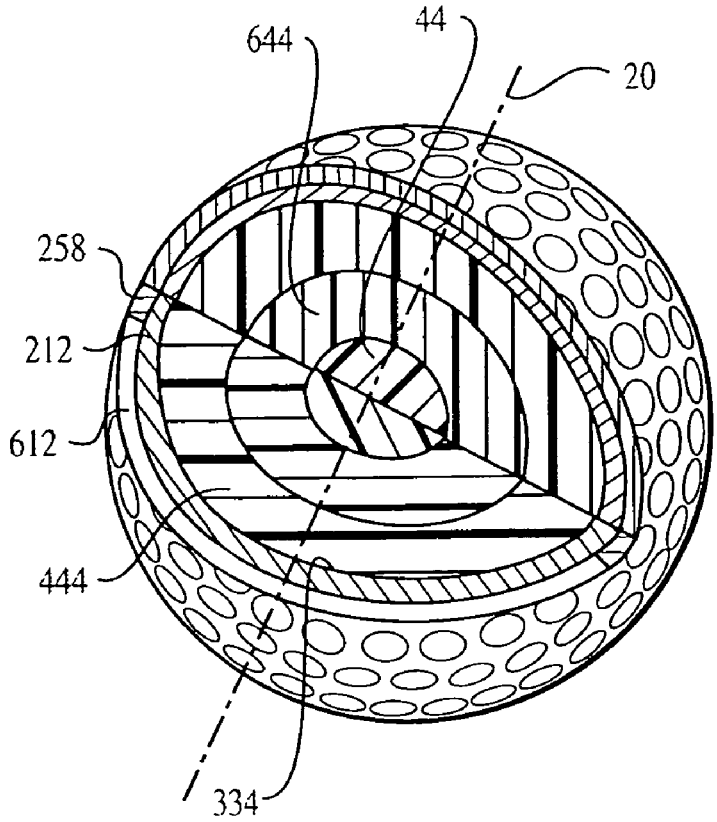
FIG. 17 is a cut-away view showing an embodiment of the present invention having a multilayer cover and a weighted band of material in the outer cover layer.

Referring now to FIG. 17, an embodiment of a golf ball of the subject invention includes a multi-layer cover comprising an inner cover layer 212 and an outer cover layer 612. The outer cover layer 612 has a band 258 of high-density material formed about a longitudinal axis of the ball, creating a gyroscopic plane aligned with and passing through the center of the band 258. The cover is formed about a three-component core 444 including inner core layer 44, outer core layer 334 and middle core layer 644. It will be recognized, however, that a core with a different number of layers or components can be utilized as well, such as 1, 2, 4, etc., and further wherein each of the one or more core layers may employ gyroscopic weighting as set forth above.

Figure 18:
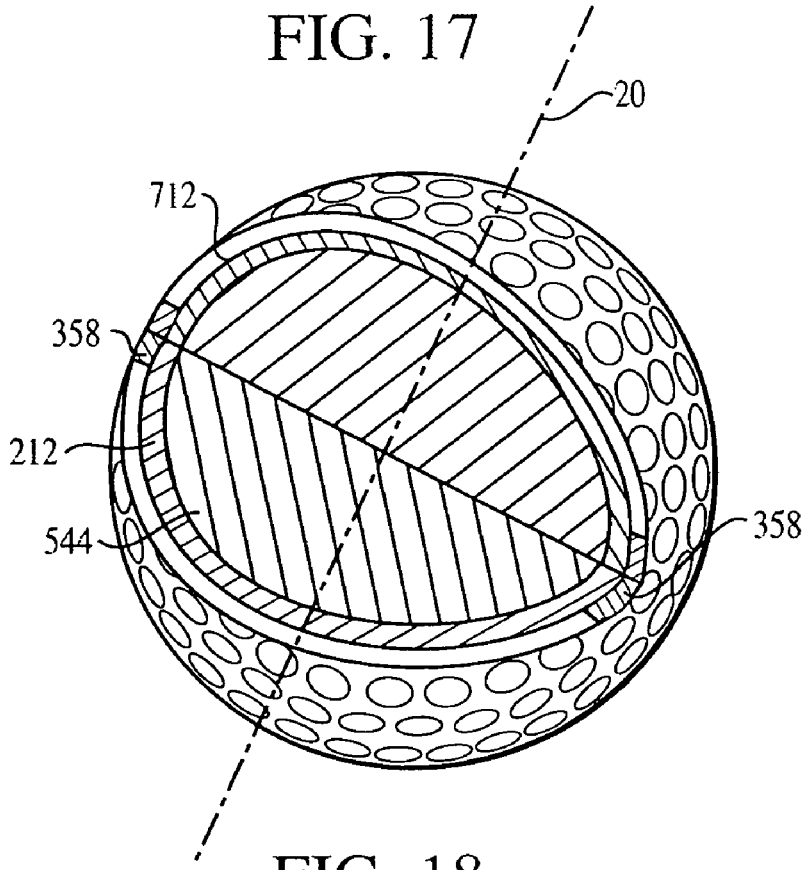
FIG. 18 shows an embodiment similar to the embodiment of FIG. 17, but wherein the weighted band is replaced by a plurality of discrete weighted segments or regions.

Referring now to FIG. 18, an embodiment of a golf ball of the present invention includes a multi-layer cover comprising an inner cover layer 212 and an outer cover layer 712. The outer cover layer 712 has multiple regions 358 formed of a high-density material spaced-apart along a longitudinal axis of the ball, creating a gyroscopic plane perpendicular to the equator and spin axis 20. Although 2 weighted regions are illustrated, any number ranging from 2 or more high-density segments 358 can be utilized. The cover is formed about a single-component core 544.

Figure 19:
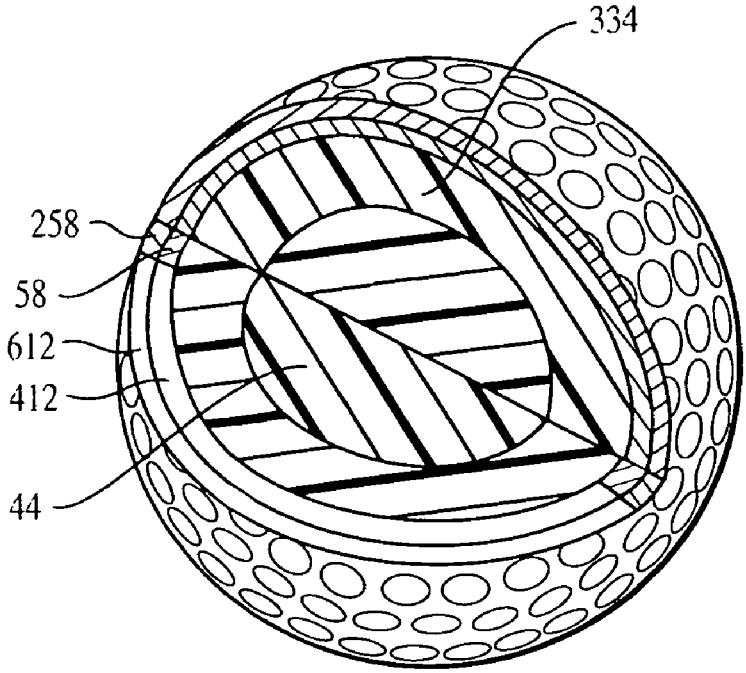
FIG. 19 is a cut-away view illustrating an embodiment of the present invention having a multilayer core and cover and a weighted band of material in both the outer cover layer and an inner cover layer, wherein the bands are positioned in such a manner to produce a gyroscopic center plane (not shown).

Referring now to FIG. 19, an embodiment of a golf ball of the subject invention includes a multi-layer cover comprising an inner cover layer 412 and an outer cover layer 612. The outer cover layer 612 has a first band 258 of high-density material formed about a longitudinal axis of the ball, creating a gyroscopic plane aligned with and passing through the center of the band 258. The inner cover layer has a second band 58 of high-density material formed therein and aligned with the first band 258. In the illustrated embodiment, the cover is formed about a two-component core comprising an outer core layer 344 and an inner core layer 44.

Figure 20:
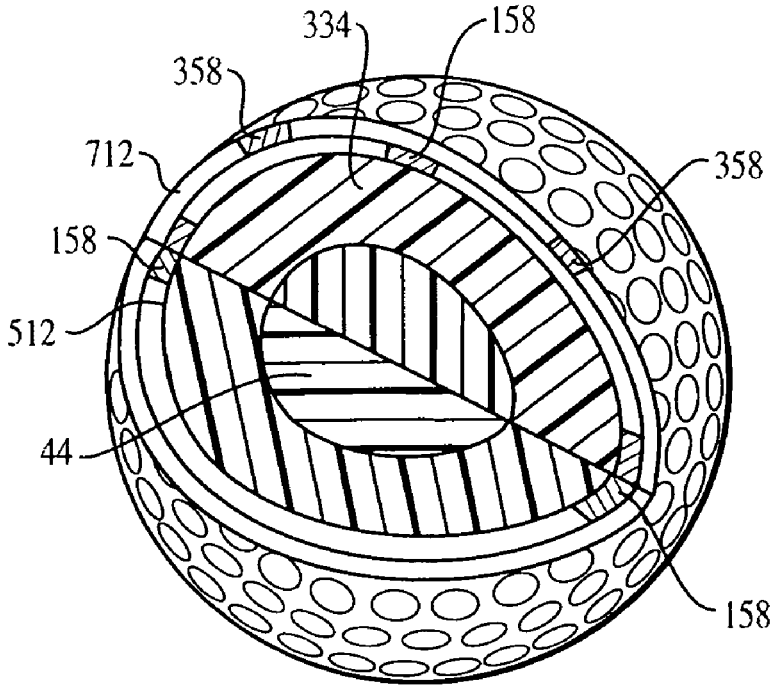
FIG. 20 shows an embodiment similar to the embodiment of FIG. 19, but wherein the weighted band is replaced by a plurality of discrete weighted segments in each of the inner and outer cover layers.

Referring now to FIG. 20, an embodiment of a golf ball of the subject invention includes a multi-layer cover comprising an inner cover layer 512 and an outer cover layer 712. The outer cover layer 712 has spaced-apart regions 358 of high-density material formed about a longitudinal axis of the ball, creating a gyroscopic plane aligned with the high-density regions 358. The inner cover layer also has a plurality of spaced apart high-density regions 158 formed therein in planar alignment with the regions 358. Although the regions 158 and 358 are in staggered or alternating configuration, it will be recognized that different numbers of weighted regions 158 and 358 can be used, and they may be aligned or staggered, so long as the weight is distributed generally evenly.

Figure 21:
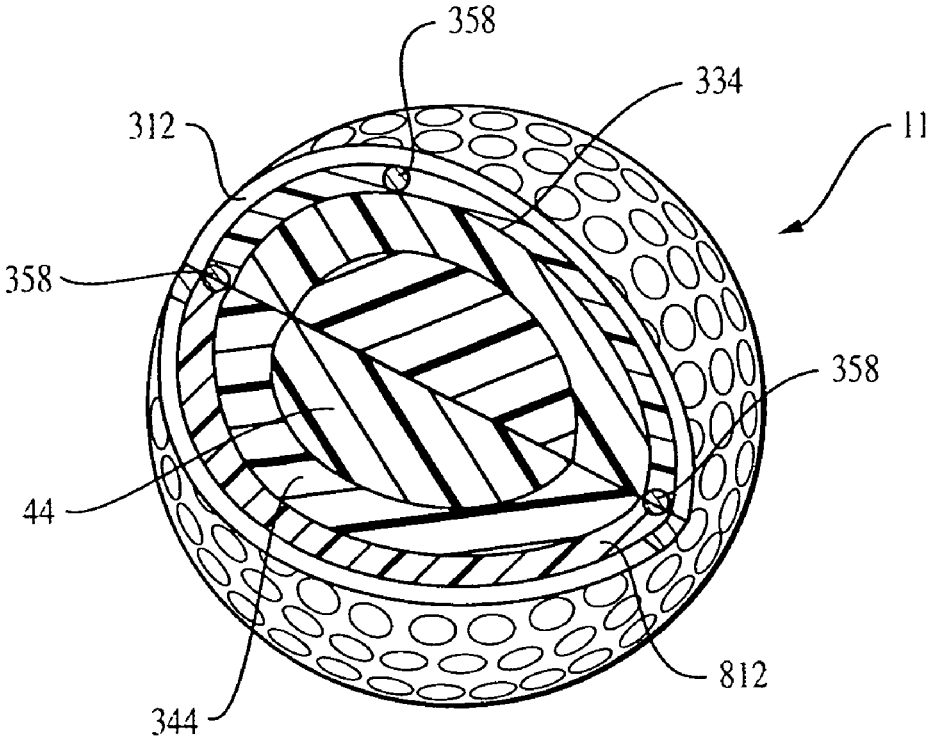
FIG. 21 is a cut-away view illustrating another embodiment of the present invention having a segmented weighted band formed in an inner cover layer in such a manner as to produce a gyroscopic center plane.

Referring now to FIG. 21, a golf ball embodiment appears which is similar to that shown in FIG. 16, wherein discrete weighted regions producing the gyroscopic effect are small weights 358. The golf ball comprises a multilayer cover component comprising outer cover layer 312 and inner cover layer 812, which has spaced apart weighted regions 358 of a high-density material, such as metal shot, pellets, ball bearings, or the like, therein. The weights 358 are disposed along an equator of the inner cover layer. Any number of weighted regions 358, ranging from 2 or more, can be utilized. Such weights can be placed during the molding process, or, can be placed in a mating cavity formed, e.g., by drilling, after the inner cover layer has been cured.

Figure 22:
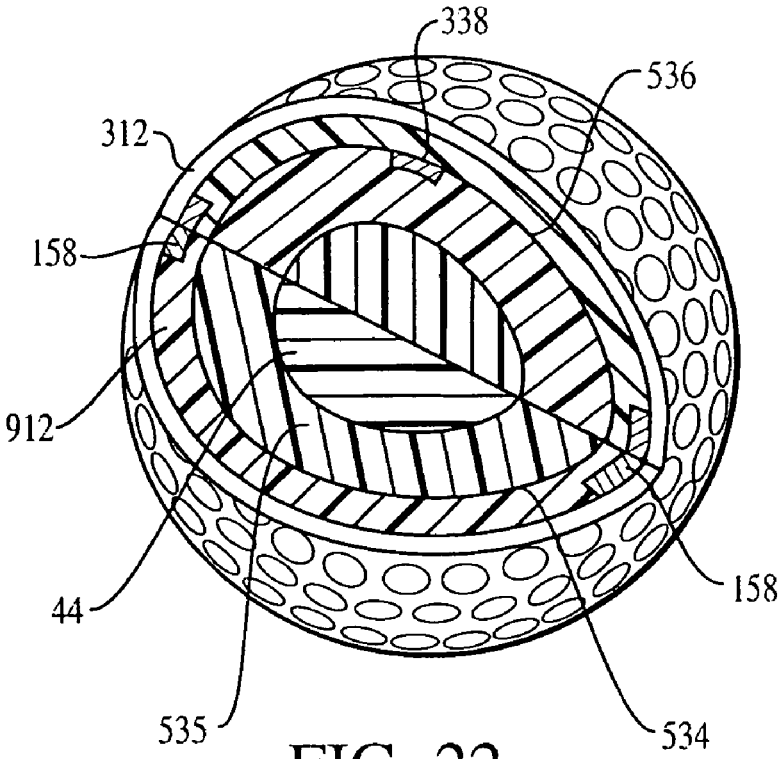
FIG. 22 illustrates an embodiment of the present invention having a segmented weighted bands in the outer core layer and the adjacent inner cover layer.

Referring now to FIG. 22, there is shown a 2×2 embodiment of the present invention having discrete weighting in both of an inner cover layer and the outer core layer. The golf ball comprises a multilayer cover component comprising outer cover layer 312 and inner cover layer 512, which has spaced apart weighted regions 158 of a high-density material therein formed along a longitudinal axis of the inner cover layer. The golf ball further includes a multi-layer core 534, which includes an inner core layer 44 and an outer core layer 535. The outer core layer 535 comprises a core body 536 and multiple (e.g., 2 or more) high-density regions 338 circumferentially and equally spaced along a longitudinal axis of the core body. Again, the inner core layer is optionally provided with high-density regions along the gyroscopic plane in like manner.

Figure 23:
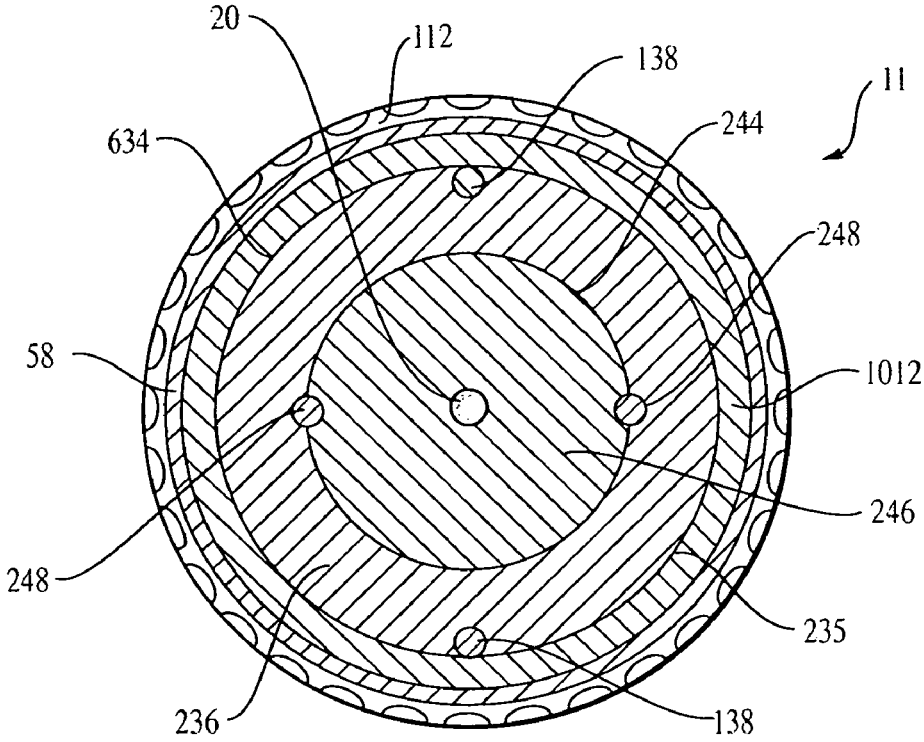
FIG. 23 is a sectional view illustrating an embodiment of the present invention having a band or region weighted material in an inner cover layer and segmented weights or regions in both the inner and outer core layers. The regions are formed in such a manner as to produce a gyroscopic center plane.

FIG. 23 illustrates a 2×2 embodiment golf ball of the present invention having a band of weighted material in an inner cover layer and segmented weights in both the inner and outer core layers. The golf ball includes a multi-layer core 634, which includes an inner core layer 244 and an outer core layer 235. The inner core layer 244 comprises a core body 246 and 2 or more (2 in the illustrated embodiment) high-density regions 248 circumferentially and equally spaced along a longitudinal axis of the inner core body, aligned with and defining a gyroscopic plane. The outer core layer 235 comprises a core body 236 and multiple high-density regions 138 (2 in the depicted embodiment) circumferentially and equally spaced along an equator of the core body, also aligned with the gyroscopic plane. The multi-layer core 634 is covered with a cover comprising an outer cover layer 112 and an inner cover layer 1012, which has a band 58 of high-density material formed about an equator of the ball, aligned with the gyroscopic plane, i.e., aligned with the plane containing the weighted regions 138 and 248.

Figure 24:
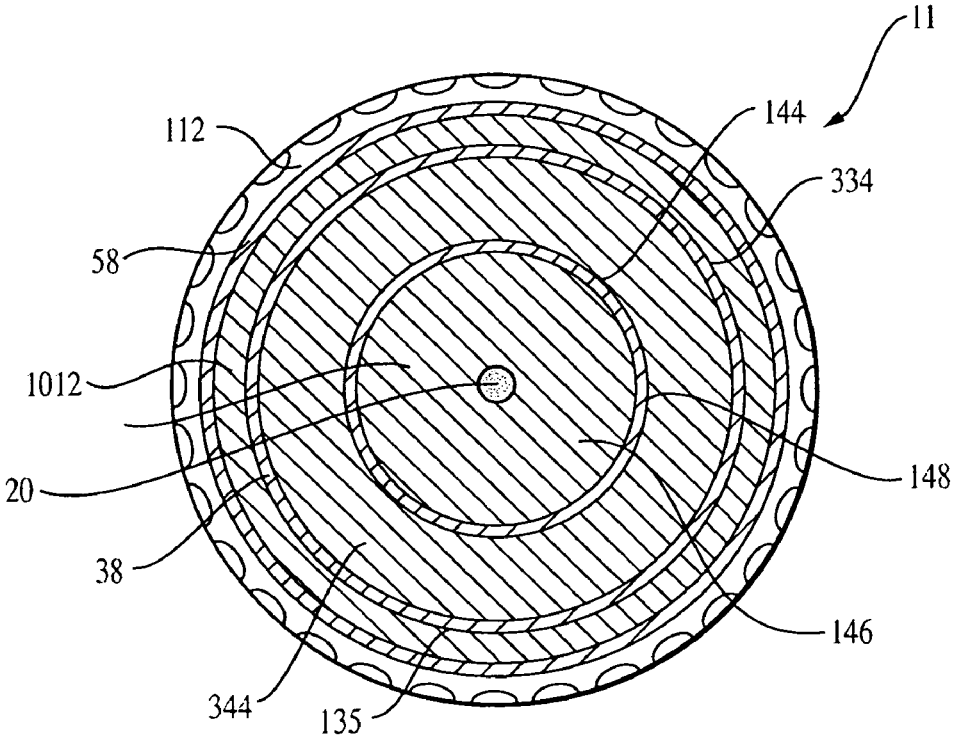
FIG. 24 illustrates an embodiment of the present invention having continuous weighted bands in an inner core layer and multiple cover layers. The bands are positioned in such a manner as to produce a gyroscopic center plane.

FIG. 24 illustrates an embodiment of the present invention having continuous weighted bands in an inner cover layer and multiple core layers. The golf ball includes a multi-layer core 334, which includes an inner core layer 144 and an outer core layer 135. The inner core layer 144 comprises a core body 146 and a high-density band 148 circumferentially disposed and aligned with a longitudinal axis of the inner core body 146. The outer core layer 135 comprises a core body 136 and a high-density band 38 thereabout, aligned with the band 148. The multi-layer core 334 is covered with a cover comprising an outer cover layer 112 and an inner cover layer 1012, which has a band 58 of high-density material formed about a longitudinal axis of the ball, aligned with the bands 38 and 148.

Figure 25:
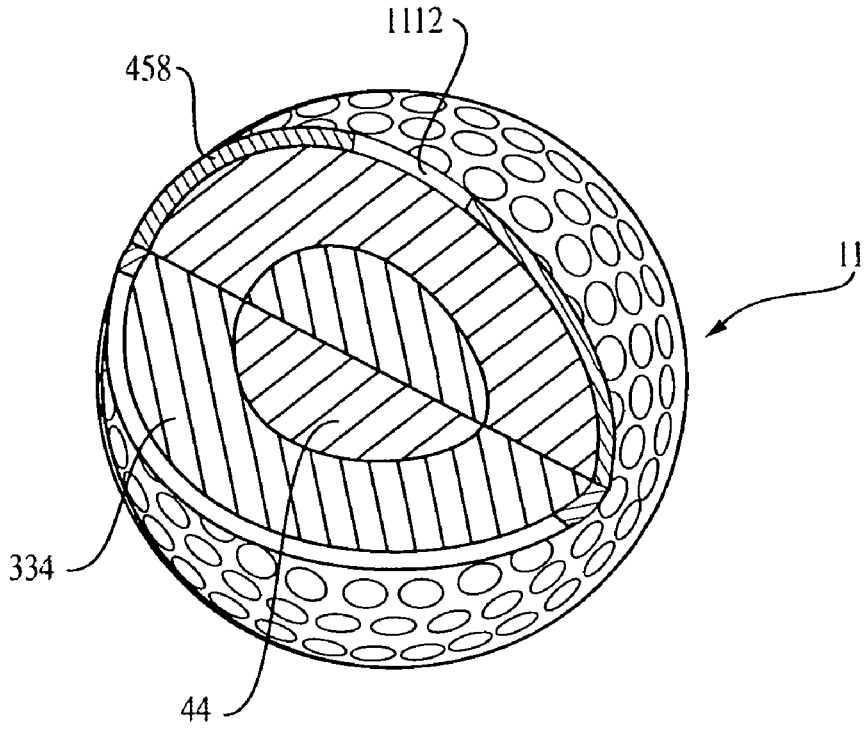
FIG. 25 is a cut-away view showing another embodiment of the present invention having a segmented weighted band in the cover layer. The segments of the weighted band are positioned in such a manner as to produce a gyroscopic center plane.

FIG. 25 illustrates a 2×1 embodiment golf ball of the present is invention having a segmented weighted band 458 in a cover layer 1112. The cover 1112 is disposed about a multi-component core 934, which includes an outer core layer 335 and an inner core layer 44, although a single-component core or a core having three or more components can be used instead.

Figure 26:
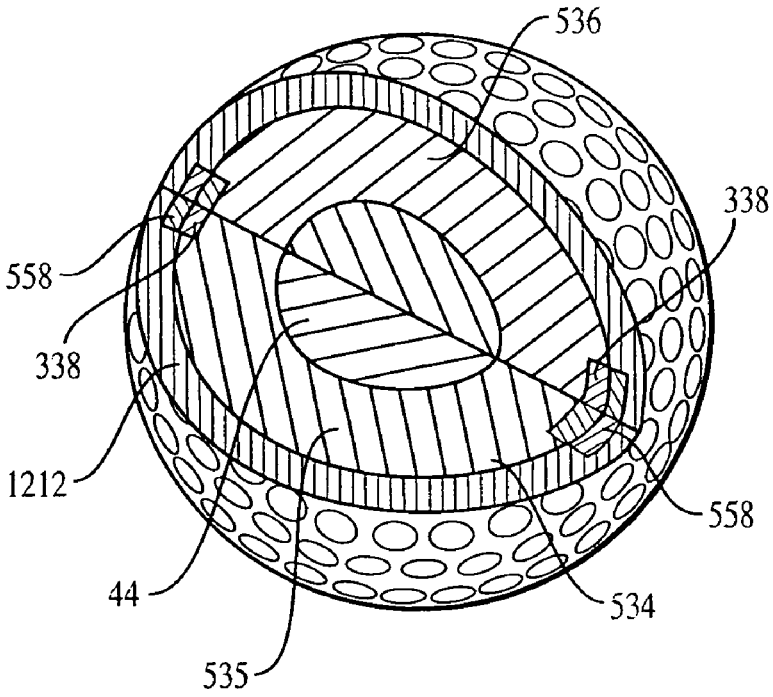
FIG. 26 illustrates an embodiment of the present invention having discrete weighted regions in the outer cover layer and the outer core layer. The regions are positioned in such a manner as to produce a gyroscopic center plane (not shown).

FIG. 26 illustrates a 2×1 embodiment of the present invention having discrete weighted regions in the outer cover layer and the outer core layer. Discrete or segmented weighted regions 558 are formed in a cover layer 1212. The cover 1212 is disposed about a multi-component core 534, which includes an inner core layer 44 and an outer core layer 535 having regions 338 of high-density material in planar alignment with the high-density regions 558. Although the regions 558 and 538 are shown in alignment, a staggered configuration is also contemplated. Also, although two weighted regions are depicted in each of the cover and outer core layers, other numbers of segments spaced about an equator of the ball are also contemplated.

It will be recognized that each of the illustrated embodiments is exemplary and explanatory only. Various other combinations of discrete and continuous bands of high-density material in one or more cover and core layers are contemplated.

Metal, metal particles, or other heavyweight (high-density) filler materials are included in the polar and/or longitudinal axis regions in order to increase the density in these regions to provide the gyroscopic effect. The continuous longitudinal weighted regions are configured as annular bands centered about the spin axis as a representative of the gyroscopic center plane, and may be a solid, high-density material, or, a region doped with a high density material. The discontinuous weighted regions are configured as segmented bands of discrete weighted regions centered about the spin axis and aligned with a longitudinal axis or plane. The high density materials preferably have a specific gravity of greater than 1.0, and more preferably greater than 1.2. Particulate materials are provided in an amount ranging from about 1 to about 100 parts per hundred parts resin (phr), preferably from about 4 to about 51 phr, and most preferably from about 10 to about 25 phr.

In certain embodiments, the core or cover component or components carrying the weighted regions are configured in a manner analogous to conventional solid cores, but modified to provide the high-density regions. Thus, for example, a core body is compression molded in the typical manner from a slug of uncured or lightly cured elastomer composition comprising a high cis-content polybutadiene and a metal salt of an α, β, ethylenically unsaturated carboxylic acid such as zinc mono or diacrylate or methacrylate. Additives can optionally be added to achieve higher coefficients of restitution in the core. The manufacturer may include a small amount of a metal oxide such as zinc oxide. In addition, larger amounts of metal oxide than those that are needed to achieve the desired coefficient may be included in order to increase the core weight so that the finished ball more closely approaches the USGA upper weight limit of 1.620 ounces. Other materials may be used in the core composition including compatible rubbers or ionomers, and low molecular weight fatty acids such as stearic acid. Free radical initiator catalysts such as peroxides are admixed with the core composition so that on the application of heat and pressure, a complex curing or cross-linking reaction takes place.

Core components having high-density regions can be formed in a number of ways. For example, a core body, i.e., a one-piece solid core, or an inner component of a multilayer core is generally spherical, but with an annular, equatorial surface depression, or, alternatively, multiple spaced apart surface depressions, which correspond to the location of the high-density region. This may be accomplished, for example, by using well-known compression or injection molding techniques with an appropriately shaped mold. Alternately, a spherical component is first molded and corresponding depressions are subsequently formed at a later stage, by material removal after the core component hardens or solidifies. Material removal is performed, for example, by cutting, grinding, ablation, routing, abrasion, or the like. The high-density regions are then formed in the depressions by filling with an high-density material, co-molding with a polymer doped with a high-density filler material, and the like. A co-molding process is advantageous in that a chemical fusion is formed between the parts.

Another technique for incorporating the high-density regions is to preform both the core body, including complimentary surface depressions as described above for retaining the high density material, and the high density regions. The high-density band or segments are separately formed in a shape complimentary to the depressions, e.g., high-density members formed of a solid material or high density composite materials formed in a separate molding or casting process using a polymeric material doped with a high-density material. The separately formed high density members are then attached, e.g., via an adhesive, to the complimentary depressions to form the finished core component.

In yet another technique, the high-density regions can be formed with the core component in a single molding process by lay up (e.g., by hand or automated process) of a high-density filler material in the corresponding regions of the mold. In this regard, the high-density filler material is advantageously used in the form of high-density particles, fibrous or filamentary strands, such as mats of continuous, long discontinuous, or short discontinuous fiber. Various forms of fiber mat can be used, including monofilament fiber, multifilament yarn, woven fabric, stitched fabrics, braids, unidirectional tapes and fabrics, non-woven fabric, roving, chopped strand mat, tow, random mat, woven roving mat, and so forth. The liquid or molten core material flows around and through, filling the interstices in the heavy filler mat material. Alternately, a prepreg comprising a partially cured resin preimpregnated with particles such as powder, flakes, whiskers, fibers, acicular particles, or other particle type listed above, may be laid up in the mold in place of the mat.

In still a further technique, when the number of segments in the discontinuous band is 2, to be located on opposing sides of the golf ball, each weighted region is first formed and placed in a hemispherical mold. The core component body is then cast in the mold, the polar regions settling to the bottom of the mold under the influence of gravity. The finished core component is then formed by adhering or fusing two such hemispheres.

When a multiple core component is produced, the layers are formed by molding processes currently well known in the golf ball art. Specifically, the golf balls can be produced by injection molding, compression molding, or a similar molding technique, an outer core layer about smaller, previously molded inner core layers. Likewise, one or more cover layers are molded about the previously molded single or multi-layer cores, with the weighted regions, if any, being formed therein in like manner. The cover layer (or outer cover layer in multilayer cover golf balls) is molded to produce a dimpled golf ball, preferably having a diameter of 1.680 inches or more. After molding, the golf balls produced may undergo various further processing steps such as buffing, painting, marking, and so forth.

The core component comprises one or more layers comprising a matrix material selected from thermosets, thermoplastics, and combinations thereof. When a dual- or multilayer core is utilized, the matrix material and other formulation components, as described in greater detail below, in the various layers may be the same or different composition. The outer diameter of the core component may vary in size and is preferably from about 1.30 inches to 1.610 inches, and is most preferably from about 1.47 inches to 1.56 inches.

The core compositions and resulting molded core layer or layers of the present invention are manufactured using relatively conventional techniques. In this regard, the core compositions of the invention preferably are based on a variety of materials, particularly the conventional rubber based materials such as cis-1,4 polybutadiene and mixtures of polybutadiene with other elastomers blended together with crosslinking agents, a free radical initiator, specific gravity controlling fillers, and the like.

Natural rubber, isoprene rubber, EPR, EPDM, styrene-butadiene rubber, or similar thermoset materials may be appropriately incorporated into the base rubber composition of the butadiene rubber to form the rubber component. It is preferred to use butadiene rubber as a base material of the composition for the one or more core layers.

Thus, in the embodiments using a multi-layer core, the same rubber composition, including the rubber base, free radical initiator, and modifying ingredients, can be used in each layer. Different specific gravity controlling fillers or amounts can be used to selectively adjust the weight or moment of inertia of the finished golf ball. Different cross-linking agents can be used to adjust the hardness or resiliency of the different core layers. However, different compositions can readily be used in the different layers, including thermoplastic materials such as a thermoplastic elastomer or a thermoplastic rubber, or a thermoset rubber or thermoset elastomer material.

Some examples of materials suitable for use as the one or more core layers further include, in addition to the above materials, polyether or polyester thermoplastic urethanes, thermoset polyurethanes or metallocene polymers, or blends thereof.

Examples of a thermoset material include a rubber based, castable urethane or a silicone rubber. More particularly, a wide array of thermoset materials can be utilized in the core components of the present invention. Examples of suitable thermoset materials include polybutadiene, polyisoprene, styrene/butadiene, ethylene propylene diene terpolymers, natural rubber polyolefins, polyurethanes, silicones, polyureas, or virtually any irreversibly cross-linkable resin system. It is also contemplated that epoxy, phenolic, and an array of unsaturated polyester resins could be utilized.

The thermoplastic material utilized in the present invention golf balls and, particularly the cores, may be nearly any thermoplastic material. Examples of typical thermoplastic materials for incorporation in the golf balls of the present invention include, but are not limited to, ionomers, polyurethane thermoplastic elastomers, and combinations thereof. It is also contemplated that a wide array of other thermoplastic materials could be utilized, such as polysulfones, polyamide-imides, polyarylates, polyaryletherketones, polyaryl sulfones/polyether sulfones, polyether-imides, polyimides, liquid crystal polymers, polyphenylene sulfides; and specialty high-performance resins, which would include fluoropolymers, polybenzimidazole, and ultrahigh molecular weight polyethylenes.

Additional examples of suitable thermoplastics include metallocenes, polyvinyl chlorides, polyvinyl acetates, acrylonitrile-butadiene-styrenes, acrylics, styrene-acrylonitriles, styrene-maleic anhydrides, polyamides (nylons), polycarbonates, polybutylene terephthalates, polyethylene terephthalates, polyphenylene ethers/polyphenylene oxides, reinforced polypropylenes, and high-impact polystyrenes.

Preferably, the thermoplastic materials have relatively high melting points, such as a melting point of at least about 300° F. Several examples of these preferred thermoplastic materials and which are commercially available include, but are not limited to, Capron™ (a blend of nylon and ionomer), Lexan™ polycarbonate, Pebax® polyetheramide and Hytrel™ polyesteramide. The polymers or resin systems may be cross-linked by a variety of means, such as by peroxide agents, sulphur agents, radiation, or other cross-linking techniques, if applicable. However, the use of peroxide crosslinking agents is generally preferred in the present invention.

Any or all of the previously described components in the cores of the golf ball of the present invention may be formed in such a manner, or have suitable fillers added, so that their resulting density is decreased or increased.

The core component of the present invention is manufactured using relatively conventional techniques. In this regard, the preferred compositions for the one or more core layers of the invention may be based on polybutadiene, and mixtures of polybutadiene with other elastomers. It is preferred that the base elastomer have a relatively high molecular weight. The broad range for the molecular weight of suitable base elastomers is from about 50,000 to about 500,000. A more preferred range for the molecular weight of the base elastomer is from about 100,000 to about 500,000. As a base elastomer for the core composition, cis-polybutadiene is preferably employed, or a blend of cis-polybutadiene with other elastomers such as polyisoprene may also be utilized. Most preferably, cis-polybutadiene having a weight-average molecular weight of from about 100,000 to about 500,000 is employed. Elastomers are commercially available and are well known in the golf ball art.

Metal carboxylate crosslinking agents are optionally included in the one or more core layers. The unsaturated carboxylic acid component of the core composition (a co-crosslinking agent) is the reaction product of the selected carboxylic acid or acids and an oxide or carbonate of a metal, such as zinc, magnesium, barium, calcium, lithium, sodium, potassium, cadmium, lead, tin, and the like. Preferably, the oxides of polyvalent metals such as zinc, magnesium and cadmium are used, and most preferably, the oxide is zinc oxide.

Exemplary of the unsaturated carboxylic acids which find utility in the present core compositions are acrylic acid, methacrylic acid, itaconic acid, crotonic acid, sorbic acid, and the like, and mixtures thereof. Preferably, the acid component is either acrylic or methacrylic acid. Usually, from about 12 to about 40, and preferably from about 15 to about 35 parts by weight of the carboxylic acid salt, such as zinc diacrylate, is included in the one or more core layers. The unsaturated carboxylic acids and metal salts thereof are generally soluble in the elastomeric base, or are readily dispersed.

The free radical initiator included in the core compositions is any known polymerization initiator (a co-crosslinking agent) which decomposes during the cure cycle. The term "free radical initiator" as used herein refers to a chemical which, when added to a mixture of the elastomeric blend and a metal salt of an unsaturated, carboxylic acid, promotes crosslinking of the elastomers by the metal salt of the unsaturated carboxylic acid. The amount of the selected initiator present is dictated only by the requirements of catalytic activity as a polymerization initiator. Suitable initiators include peroxides, persulfates, azo compounds and hydrazides. Peroxides are readily commercially available and known in the art. They are conveniently used in the present invention, generally in amounts of from about 0.5 to about 4.0 and preferably in amounts of from about 1.0 to about 3.0 parts by weight per each 100 parts of elastomer and based on 40% active peroxide with 60% inert filler.

Exemplary of suitable peroxides for the purposes of the present invention are dicumyl peroxide, n-butyl 4,4'-bis (butylperoxy) valerate, 1,1-bis(t-butylperoxy)-3,3,5-trimethyl cyclohexane, di-t-butyl peroxide and 2,5-di-(t-butylperoxy)-2,5 dimethyl hexane and the like, as well as mixtures thereof. It will be understood that the total amount of initiators used will vary depending on the specific end product desired and the particular initiators employed.

The core compositions of the present invention may additionally contain any other suitable and compatible modifying ingredients including, but not limited to, metal oxides, fatty acids, diisocyanates, and polypropylene powder resin.

Various activators may also be included in the compositions of the present invention. For example, zinc oxide, calcium oxide and/or magnesium oxide are activators for the polybutadiene. The activator can range from about 2 to about 30 parts by weight per 100 parts by weight of the rubbers (phr) component.

Fatty acids or metallic salts of fatty acids may also be included in the compositions, functioning to improve moldability and processing. Generally, free fatty acids having from about 10 to about 40 carbon atoms, and preferably having from about 15 to about 20 carbon atoms, are used. Exemplary of suitable fatty acids are stearic acid and linoleic acids, as well as mixtures thereof. Exemplary of suitable metallic salts of fatty acids include zinc stearate. When included in the core compositions, the fatty acid component is present in amounts of from about 1 to about 25, preferably in amounts from about 2 to about 15 parts by weight based on 100 parts rubber (elastomer).

It is preferred that the core compositions include zinc stearate as the metallic salt of a fatty acid in an amount of from about 2 to about 20 parts by weight per 100 parts of rubber.

Diisocyanates may also be optionally included in the core compositions. The diisocyanates act here as moisture scavengers. When utilized, the diioscyanates are included in amounts of from about 0.2 to about 5.0 parts by weight based on 100 parts rubber. Exemplary of suitable diisocyanates is 4,4'-diphenylmethane diisocyanate and other polyfunctional isocyanates known to the art.

Furthermore, the dialkyl tin difatty acids set forth in U.S. Pat. No. 4,844,471, the dispersing agents disclosed in U.S. Pat. No. 4,838,556, and the dithiocarbamates set forth in U.S. Pat. No. 4,852,884 may also be incorporated into the polybutadiene compositions of the present invention. The specific types and amounts of such additives are set forth in the above identified patents, which are incorporated herein by reference in its entirety.

The preferred core components of the invention are generally comprised of 100 parts by weight of a base elastomer (or rubber) selected from polybutadiene and mixtures of polybutadiene with other elastomers, such as polyisoprene, 12 to 40 parts by weight of at least one metallic salt of an unsaturated carboxylic acid, and 0.5 to 4.0 parts by weight of a free radical initiator (40% active peroxide). However, as mentioned above, the use of at least one metallic salt of an unsaturated carboxylic acid is preferably not included in the formulation of the high-density center core layer.

In addition to polybutadiene, the following commercially available thermoplastic resins are also particularly suitable for use in the noted dual cores employed in the golf balls of the present invention: Capron™ 8351 (available from Allied Signal Plastics), Lexan™ ML5776 (from General Electric), Pebax® 3533 (a polyether block amide from Elf Atochem), and Hytrel™ G4074 (a polyether ester from DuPont).

In addition, various polyisoprenes may also be included in the core components of the present invention.

As mentioned above, the present invention includes golf ball embodiments that utilize one or more core components. For multiple-component cores, a core assembly is provided that comprises a central core component and one or more core layers disposed about the central core component. The second, third, and higher numbers of core layers may be the same as or different from each other and the central core layer.

In producing the golf ball single component cores, and the center or outer layers of multi-component cores, the desired ingredients are intimately mixed, for instance, using two roll mills or a Banbury™ mixer until the composition is uniform, usually over a period of from about 5 to about 20 minutes. The sequence of addition of components is not critical. A preferred blending sequence is described below.

The matrix material or elastomer, powdered metal zinc salt (if desired), a high specific gravity additive such as powdered metal (if desired), a low specific gravity additive (if desired), metal oxide, fatty acid, and the metallic dithiocarbamate (if desired), surfactant (if desired), and tin difatty acid (if desired), are blended for about 7 minutes in an internal mixer such as a Banbury™ mixer. As a result of shear during mixing, the temperature rises to about 200° F. The mixing is desirably conducted in such a manner that the composition does not reach incipient polymerization temperatures during the blending of the various components. The initiator and diisocyanate are then added and the mixing continued until the temperature reaches about 220° F. whereupon the batch is discharged onto a two roll mill, mixed for about one minute and sheeted out.

The sheet is rolled into a "pig" and then placed in a Barwell™ preformer and slugs of the desired weight are produced. The slugs to be used for the core (or center core layer) are then subjected to compression molding at about 140° C. to about 170° C. for about 10 to 50 minutes. Note that the temperature in the molding process is not always required to be constant, and may be changed in two or more steps. In fact, the slugs for the outer core layer are frequently preheated for about one-half hour at about 75° C. prior to molding. After molding, the molded cores (or center layer thereof for multi-component cores) are cooled, the cooling effected, for example, at room temperature for about 4 hours or in cold water for about one hour. The molded cores/center core layers are subjected to a centerless grinding operation whereby a thin layer of the molded core is removed to produce a round center. Alternatively, the cores/center layers are used in the as-molded state with no grinding needed to achieve roundness.

The center is converted into a dual- or multi-layer core by providing at least one layer of core material thereon, which again, may be of similar or different matrix material as the center. Preferably, the outer core layer(s), where present, comprises polybutadiene. Optionally, for example, where a golf ball meeting specified weight requirements is desired, one or more of the inner and outer core layers are weight-adjusted to compensate for the spin-correcting, high-density equatorial and/or polar regions.

In producing a multi-component core, the one or more outer core layers can be applied around the spherical center by several different types of molding processes. For example, the compression molding process for forming the cover layer(s) of a golf ball that is set forth in U.S. Pat. No. 3,819,795, incorporated herein by reference in its entirety, can be adapted for use in producing the core layer(s) of the present invention.

In such a modified process, preforms or slugs of the outer core material, i.e., the thermoset material utilized to form the outer core layer, are placed in the upwardly open, bottom cavities of a lower mold member of a compression molding assembly, such as a conventional golf ball or core platen press. The upwardly facing hemispherical cavities have inside diameters substantially equal to the finished core to be formed. In this regard, the inside diameters of the cavities are slightly larger (i.e., approximately 2.0 percent larger) than the desired finished core size in order to account for material shrinkage.

An intermediate mold member comprising a center Teflon®-coated plate having oppositely-affixed hemispherical protrusions extending upwardly on the upper surface and extending downwardly on the lower surface, each hemispherical protrusion sized to be substantially equal to the centers to be utilized and thus can vary with the various sizes of the centers to be used.

Additional preforms of the same outer core material are subsequently placed on top of the upwardly-projecting hemispherical protrusions affixed to the upper surfaces of the Teflon®-coated plate of the intermediate mold member. The additional preforms are then covered by the downwardly open cavities of the top mold member. Again the downward facing cavities of the top mold member have inside diameters substantially equal to the core to be formed.

Specifically, the bottom mold member is engaged with the top mold member with the intermediate mold member having the oppositely protruding hemispheres being present in the middle of the assembly. The mold members are then compressed together to form hemispherical core halves.

In this regard, the mold assembly is placed in a press and cold formed at room temperature using approximately 10 tons of pressure in a steam press. The molding assembly is closed and heated below the cure activation temperature of about 150° F. for approximately four minutes to soften and mold the outer core layer materials. While still under compression, but at the end of the compression cycle, the mold members are water cooled to a temperature to less than 100° F. in order to maintain material integrity for the final molding step. This cooling step is beneficial since cross linking has not yet proceeded to provide internal chemical bonds to provide full material integrity. After cooling, the pressure is released.

The molding assembly is then opened, the upper and lower mold members are separated, and the intermediate mold member is removed while maintaining the formed outer core layer halves in their respective cavities. Each of the halves has an essentially perfectly formed one-half shell cavity or depression in its uncured thermoset material. These one-half shell cavities or depressions were produced by the hemispherical protrusions of the intermediate mold member. Previously molded centers are then placed into the bottom cavities or depressions of the uncured thermoset material. The top portion of the molding assembly is subsequently engaged with the bottom portion and the material that is disposed therebetween is cured for about 12 minutes at about 320° F. Those of ordinary skill in the art relating to free radical curing agents for polymers are conversant with adjustments of cure times and temperatures required to effect optimum results with any specific free radical agent. The combination of the high temperature and the compression force joins the core halves, and bonds the cores to the center. This process results in a substantially continuously outer core layer being formed around the center component.

In an alternative, and in some instances, more preferable compression molding process, the Teflon®-coated plate of the intermediate mold member has only a set of downwardly projecting hemispherical protrusions and no oppositely affixed upwardly-projecting hemispherical protrusions. Substituted for the upwardly-projecting protrusions are a plurality of hemispherical recesses in the upper surface of the plate. Each recess is located in the upper surface of the plate opposite a protrusion extending downwardly from the lower surface. The recess has an inside diameter substantially equal to the center to be utilized and is configured to receive the bottom half of the center.

The previously molded centers are then placed in the cavities located on the upper surface of the plate of the intermediate mold member. Each of the centers extends above the upper surface of the plate of the intermediate mold member and is pressed into the lower surface of the upper preform when the molds are initially brought together during initial compression.

The molds are then separated and the plate removed, with the centers being retained (pressed into) the half shells of the upper preforms. Mating cavities or depressions are also formed in the half shells of the lower preforms by the downwardly projecting protrusions of the intermediate mold member. With the plate now removed, the top portion of the molding assembly is then joined with the bottom portion. In so doing, the centers projecting from the half shells of the upper performs enter into the cavities or depressions formed in the half shells of the lower preforms. The material included in the molds is subsequently compressed, treated and cured as stated above to form a golf ball core having a centrally located center and an outer core layer. This process can continue for any additional added core layers.

After molding, the core (optionally surrounded by one or more outer core layers) is removed from the mold and the surface thereof preferably is treated to facilitate adhesion thereof to the covering materials. Surface treatment can be effected by any of the several techniques known in the art, such as corona discharge, ozone treatment, sand blasting, brush tumbling, and the like. Preferably, surface treatment is effected by grinding with an abrasive wheel.

As stated above, the golf balls of the subject invention may be a one piece (unitary ball with no cover layer) golf ball with weights embedded in the surface, or they may include a cover, which may comprise a single layer or multiple layers.

Referring now to dual- and multi-layer covers, the inner cover layer is preferably in one embodiment harder than the outer cover layer and generally has a thickness in the range of 0.01 to 0.10 inches, preferably 0.03 to 0.07 inches for a 1.68 inch ball and 0.05 to 0.10 inches for a 1.72 inch (or more) ball. The core and inner cover layer together form an inner ball having a coefficient of restitution of 0.780 or more and more preferably 0.790 or more, and a diameter in the range of 1.48–1.64 inches for a 1.68 inch ball and 1.50–1.70 inches for a 1.72 inch (or more) ball. The above-described characteristics of the inner cover layer provide an inner ball having a PGA compression of 100 or less. It is found that when the inner ball has a PGA compression of 90 or less, excellent playability results.

Materials suitable for the inner cover layer are known in the art. Examples of suitable materials for the inner layer compositions include the high acid and low acid ionomers such as those developed by E.I. DuPont de Nemours & Company under the trademark "Surlyn®" and by Exxon Corporation under the trademark "Escor™" or trade name "lotek", or blends thereof. Examples of compositions which may be used as the inner layer herein are set forth in detail in a continuation of U.S. application Ser. No. 08/174,765, which is a continuation of U.S. application Ser. No. 07/776,803 filed Oct. 15, 1991, and Ser. No. 08/493,089, which is a continuation of Ser. No. 07/981,751, which in turn is a continuation of Ser. No. 07/901,660 filed Jun. 19, 1992, each of which is incorporated herein by reference in its entirety. Of course, the inner layer high acid ionomer compositions are not limited in any way to those compositions set forth in said applications. Other examples may be found in U.S. Pat. No. 5,688,869, incorporated herein by reference in its entirety. Additional materials suitable for use as the inner cover layer include low acid ionomers, which are known in the art. Other materials suitable for use as the inner cover layer include fully non-ionomeric thermoplastic materials. Suitable non-ionomeric materials include metallocene catalyzed polyolefins or polyamides, polyamide/ionomer blends, polyphenylene ether/ionomer blends, etc., which have a Shore D hardness of ≧60 and a flex modulus of greater than about 30,000 psi, or other hardness and flex modulus values which are comparable to the properties of the ionomers described above. Other suitable materials include but are not limited to thermoplastic or thermosetting polyurethanes, a polyester elastomer such as that marketed by DuPont under the trademark Hytrel™ (polyester ester), or a polyether amide such as that marketed by Elf Atochem S.A. under the trademark Pebax®, a blend of two or more non-ionomeric thermoplastic elastomers, or a blend of one or more ionomers and one or more non-ionomeric thermoplastic elastomers.

Still referring to embodiments having dual- or multi-layer covers, the core component and the hard inner cover layer formed thereon provide the subject golf ball with power and distance. The outer cover layer is preferably comparatively softer than the inner cover layer. The softness provides for the feel and playability characteristics typically associated with balata or balata-blend balls. The outer cover layer or ply is comprised of a relatively soft, low modulus (about 1,000 psi to about 10,000 psi) and, in an alternate embodiment, low acid (less than 16 weight percent acid) ionomer, an ionomer blend, a non-ionomeric thermoplastic or thermosetting material such as, but not limited to, a metallocene catalyzed polyolefin such as EXACT™ material available from EXXON®, a polyurethane, a polyester elastomer such as that marketed by DuPont under the trademark Hytrel™, or a polyether amide such as that marketed by Elf Atochem S.A. under the trademark Pebax®, a blend of two or more non-ionomeric thermoplastic or thermosetting materials, or a blend of one or more ionomers and one or more non-ionomeric thermoplastic materials.

The outer layer is fairly thin (i.e. from about 0.010 to about 0.10 inches in thickness, more desirably 0.03 to 0.06 inches in thickness for a 1.680 inch ball and 0.03 to 0.06 inches in thickness for a 1.72 inch or more ball), but thick enough to achieve desired playability characteristics while minimizing expense. Thickness is defined as the average thickness of the non-dimpled areas of the outer cover layer. Preferably, the outer cover layer has a Shore D hardness of at least 1 point softer than the inner cover.

The outer cover layer of the invention is formed over a core to result in a golf ball having a coefficient of restitution of at least 0.760, more preferably at least 0.770, and most preferably at least 0.780. The coefficient of restitution of the ball will depend upon the properties of both the core and the cover. The PGA compression of the golf ball is 100 or less, and preferably is 90 or less.

Additional materials may also be added to the inner and outer cover layer of the present invention as long as they do not substantially reduce the playability properties of the ball. Such materials include dyes (for example, Ultramarine Blue™ sold by Whitaker, Clark, and Daniels of South Plainsfield, N.J.) (see U.S. Pat. No. 4,679,795), pigments such as titanium dioxide, zinc oxide, barium sulfate and zinc sulfate; UV absorbers; optical brighteners such as Eastobrite™ OB-1 and Uvitex™ OB antioxidants; antistatic agents; and stabilizers. Moreover, the cover compositions of the present invention may also contain softening agents such as those disclosed in U.S. Pat. Nos. 5,312,857 and 5,306,760, including plasticizers, metal stearates, processing acids, etc., and reinforcing materials such as glass fibers and inorganic fillers, as long as the desired properties produced by the golf ball covers of the invention are not is impaired.

The following examples illustrate various aspects of the present invention. The examples are provided for the purposes of illustration and are in no way intended to limit the scope of the invention.

EXAMPLES

Example 1

Cores having a diameter of about 1.54 inches were formed having the following formulation (amounts of ingredients are in parts per hundred rubber (phr) based on 100 parts butadiene rubber):

| Core Formulation A | PHR |
|---|---|
| CB-10 polybutadiene | 100 |
| Zinc Oxide | 12 |
| Zinc Stearate | 16 |
| ZDA | 25.3 |
| Peroxide | 1.25 |
| | 154.55 |

Sp. Gr. 1.106

| Molded Core Properties | |
|---|---|
| Size (pole) | 1.537" |
| Size (off/Eq.) | 1.541" |
| Riehle Compression | 99 |
| C.O.R. | .804 |
| Weight | 34.44 grams |

Cores were divided into 4 groups as follows:

Group 1

A single layer of 3M Scotch™ Brand ½" wide lead tape 0.005" thick with self adhesive was wrapped in a single layer around the longitudinal axis of the core. The cores weighed 36.21 grams.

Group 2

Same as Group 1 above except 2 layers of lead tape were used. The cores weighed 37.98 grams.

Group 3

Three 7/32" steel balls were pushed into equally spaced 13/64" drilled holes around the core's equator or parting line. The steel balls after inserting into the holes were flush with the core surface. The cores weighed 36.05 grams.

Group 4

Two 0.250" lead shots were placed in 15/64" drilled holes 180° apart on the equator. The lead shot was pounded to peen the lead shot flush with the surface of the core. The cores weighed 37.28 grams.

| Core Formulation B | PHR |
|---|---|
| CB-10 polybutadiene | 100 |
| Zinc Oxide | 5 |
| Zinc Stearate | 10 |
| ZDA | 28 |
| Peroxide | 1.25 |
| | 144.25 |

Sp. Gr. 1.075

| Molded Core Properties | |
|---|---|
| Size (pole) | 1.536" |
| Size (off/Eq.) | 1.537" |
| Weight | 33.54 grams |

-continued

| Molded Core Properties | |
|---|---|
| Riehle Compression | 90 |
| C.O.R. | .806 |

Group 5

Four 7/32" brass balls were pushed into equally spaced 13/64" drilled holes around the core's longitudinal axis. The brass balls after inserting into the holes were flush with the equator of the core. The cores weighed 36.16 grams.

Group 6

Five 7/32" steel balls were pushed into equally spaced 13/64" drilled holes around the core's equator. The steel balls were flush with the core surface. The cores weighed 36.55 grams.

Core types 1 thru 6 were injection molded into 1.680" golf balls. The cover stock was an ionomer blend having a Shore D hardness of 68. The balls had the following properties:

| Ball Type | Size (inches) | Weight (grams) | Compression (Riehle) | C.O.R. |
|---|---|---|---|---|
| Control (No weights) | 1.679 | 45.0 | 60 | .813 |
| Group 1 | 1.679 | 44.6 | 78 | .805 |
| Group 2 | 1.680 | 46.2 | 77 | .801 |
| Group 3 | 1.677 | 44.8 | 80 | .813 |
| Group 4 | 1.678 | 45.9 | 77 | .806 |
| Group 5 | 1.680 | 45.0 | 74 | .802 |
| Group 6 | 1.681 | 45.4 | 74 | .802 |

Durability—Finished Golf Balls were fired at 155 ft/second against a 2" thick steel plate.

| Ball Type | Blows |
|---|---|
| Control - No weights | 50 blows - no breaks |
| Group 1 - single lead tape | 50 blows - no breaks |
| Group 3 - 3 7/32" steel balls | 47 blows to breaks |
| Group 4 - 2 1/4" lead shots | 31 blows to break |
| Group 5 - 4 7/32" brass balls | 38 blows to breaks |
| Group 6 - 5 7/32" steel balls | 47 blows to breaks |

Durability Specification—No breaks below 20 blows

The golf balls were tested on a mechanical golfing machine (Iron Byron) using a Top-Flite® Intimidator™ Driver at 132 feet per second club head speed, set up to produce a high pull slice on a conventional 2 piece control golf ball. All balls were teed up randomly with regard to pole and equator orientation.

Driving Machine Test Results

| Ball Type | Center Line Deviation (yds) | Total Distance (Yds) |
|---|---|---|
| Control - no weights | 15.2 | 211.1 |
| Group 5 - 4 7/32" brass balls | 12.7 | 210.5 |
| Group 6 - 5 7/32" steel balls | 11.9 | 208.8 |
| Group 3 - 3 7/32" steel balls | 10.5 | 209.0 |
| Group 1 - single lead tape | 9.6 | 205.0 |

-continued

Driving Machine Test Results

| Ball Type | Center Line Deviation (yds) | Total Distance (Yds) |
|---|---|---|
| Group 2 - double lead tape | 9.1 | 207.5 |
| Group 4 - 2 lead shots | 8.6 | 207.2 |

The above results show that all of the experimental test balls reduced slicing. Group 4 balls had the greatest effect as they deviated only 8.6 yards from the center line of the Test Range.

Example 2

Two uncured polybutadiene hemisphere cores (1.544" in diameter, about 18.5 grams in weight) were formed having a low specific gravity (Sp. Gr. 1.088). A high specific gravity (Sp. Gr. 2 to 14 or more) washer shaped ring formed out of tungsten/polybutadiene stock was placed in between the two hemispheres. The combination was then molded and cured together to form a core (1.540" in diameter) of a golf ball.

The tungsten/polybutadiene washers were formed out of the tungsten/polybutadiene stock set forth below (Sp. Gr. 7.80) and sheeted out on the mill to 0.030"–0.040" thickness. Rings of 1.540" in diameter and 1.0" in diameter were utilized for die cut washers having an outer diameter of 1.540" and an inner diameter of 1.0". The average weight of eight of these tungsten/polybutadiene washer/rings was about 4.6 grams.

Tungsten/Polybutadiene Core Stock (Sp. Gr. 7.80)

| MATERIAL | ACTUAL PHR | Sp. Gr |
|---|---|---|
| Goodyear ® Natsyn ® 2200 | 50.00 | 0.910 |
| Enichem Neo-Cis ® 40 | 50.00 | 0.910 |
| Tungsten Powder | 1386.40 | 19.350 |
| Black Iron Oxide | 64.90 | 5.100 |
| Zinc Oxide | 5.00 | 5.570 |
| Peroxide | 7.50 | 1.410 |
| TOTALS | 1563.80 | 7.800 |

Polybutadiene Core Stock (Sp. Gr. 1.088)

| | pph | Sp. Gr. | Sp. Vol. | |
|---|---|---|---|---|
| CB-10 | 70 | .91 | 109.84 | |
| Neo Cis ® 60 | 30 | | | |
| ZnO | 6 | 5.57 | 1.08 | |
| ZnSt | 40 | 1.09 | 9.17 | |
| ZDA | 30 | 2.10 | 14.29 | |
| Yellow M.B. | 0.1 | | | |
| Peroxide | 1.25 | 1.40 | .89 | |
| | 147.35 | | 135.32 | = Sp. Gr. 1.088 |

The uncured polybutadiene cores were formed in a 10 cavity mold using a solid, flat Teflon® (Dupont) plate between ½ slugs, 4' at full steam, 10 minute minimum water. The mold was opened, and the Teflon® plate was removed. The above produced tungsten/polybutadiene washers were then added to one-half of the hemisphere and the hemispheres were then molded together. The molded centers had the following characteristics:

| | |
|---|---|
| Size (pole) = | 1.544" |
| Weight = | 36.2 grams |
| Comp (Richle) = | 90 |
| C.O.R. = | .794 |

The two piece cores were then injection molded with an ionomer resin cover. The resulting balls when spun, quickly found their spin axis. In addition to the metal powder/polymeric washers or 'O' rings, other high density materials such as metal rings could also be utilized.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims and the equivalents thereof.

Having thus described the preferred embodiments, the invention is now claimed to be:

1. A golf ball comprising:

a core, said core having a diameter ranging from 1.30 to 1.61 inches, said core comprising a polybutadiene material, said core defining at least one hollow channel extending around the longitudinal axis of the core perpendicular to the ball's spin axis;

at least one high-density region disposed in said hollow channel, the high density region comprising a metallic band, the metallic band having a density greater than the polybutadiene material of the core and a density greater than 4.0 grams per cubic centimeter; and an inner cover layer disposed about the core and the high density region, the inner cover layer having a thickness ranging from 0.01 to 0.1 inch;

an outer cover layer disposed over the inner cover layer, the outer cover layer having a thickness ranging from 0.01 to 0.10 inch.

* * * * *